US007205894B1

(12) United States Patent
Savage

(10) Patent No.: US 7,205,894 B1
(45) Date of Patent: Apr. 17, 2007

(54) MISSING GOLF CLUB REMINDER AND WIRELESS GOLF BAG ALARM SYSTEM

(76) Inventor: Paul A. Savage, 415 E. Main St., Suite 340, Canfield, OH (US) 44406

( * ) Notice: Subject to any disclaimer, the term of this patent is extended or adjusted under 35 U.S.C. 154(b) by 109 days.

(21) Appl. No.: 10/873,677

(22) Filed: Jun. 22, 2004

(51) Int. Cl.
*G08B 13/14* (2006.01)

(52) U.S. Cl. ..... 340/568.6; 340/539.32; 340/568.1; 340/572.1; 340/686.6

(58) Field of Classification Search ..... 340/568.6, 340/539.13, 539.23, 539.32, 568.1, 572.1, 340/572.6, 686.1, 686.6, 686.4
See application file for complete search history.

(56) References Cited

U.S. PATENT DOCUMENTS

| | | | |
|---|---|---|---|
| 2,334,801 | A | 11/1943 | Gazeley |
| 3,988,724 | A | 10/1976 | Anderson |
| 4,042,918 | A | 8/1977 | Klitzman |
| 4,489,314 | A | 12/1984 | Miller |
| 4,833,456 | A | 5/1989 | Heller |
| 4,940,966 | A | 7/1990 | Pettigrew et al. |
| 4,991,413 | A | 2/1991 | Arnaldo |
| 5,004,100 | A | 4/1991 | Smith |
| 5,028,909 | A | 7/1991 | Miller |
| 5,041,815 | A | 8/1991 | Newton |
| 5,124,699 | A | 6/1992 | Tervoert et al. |
| 5,126,719 | A | 6/1992 | DeSorbo |
| 5,132,622 | A | 7/1992 | Valentino |
| 5,204,681 | A | 4/1993 | Greene |
| 5,252,948 | A | 10/1993 | Goris et al. |
| 5,289,163 | A | 2/1994 | Perez et al. |
| 5,291,205 | A | 3/1994 | Greene |
| 5,302,954 | A | 4/1994 | Brooks et al. |
| 5,341,125 | A | 8/1994 | Plonsky et al. |
| 5,392,028 | A | 2/1995 | Pichl |
| 5,444,223 | A | 8/1995 | Blama |
| 5,481,259 | A | 1/1996 | Bane |
| 5,493,274 | A | 2/1996 | Long |
| 5,517,195 | A | 5/1996 | Narlow et al. |
| 5,534,682 | A | 7/1996 | Graef et al. |
| D372,679 | S | 8/1996 | Giannini |
| 5,546,196 | A | 8/1996 | Huot et al. |
| 5,565,845 | A | 10/1996 | Hara |
| 5,589,819 | A | 12/1996 | Takeda |
| 5,591,951 | A | 1/1997 | Doty |

(Continued)

FOREIGN PATENT DOCUMENTS

| | | |
|---|---|---|
| GB | 2 334 801 | 1/1999 |

(Continued)

*Primary Examiner*—Daryl C Pope
(74) *Attorney, Agent, or Firm*—Caesar, Rivise, Bernstein, Cohen & Pokotilow, Ltd.

(57) ABSTRACT

A missing golf club warning system that automatically counts and displays the number of golf clubs removed, and not restored, to a golf club bag and further alerts the golfer as he/she is in motion and leaving the area where at least one golf club was removed from the bag and left behind. In addition, this warning system includes a wireless golf bag alarm system which automatically and remotely notifies the golf club/bag owner, and even golf grounds personnel, who at the time may be some distance from and out of visual contact with the bag, as to the non-authorized removal of a club, or of the movement or transport of the golf bag.

48 Claims, 21 Drawing Sheets

U.S. PATENT DOCUMENTS

| | | | | |
|---|---|---|---|---|
| 5,594,420 | A | 1/1997 | Copeland et al. | |
| 5,608,379 | A | 3/1997 | Narlow et al. | |
| 5,610,585 | A | 3/1997 | Jobe | |
| 5,626,531 | A | 5/1997 | Little | |
| 5,682,143 | A | 10/1997 | Brady et al. | |
| 5,686,882 | A | 11/1997 | Giani | |
| 5,783,996 | A | 7/1998 | Muszynski | |
| 5,844,483 | A | 12/1998 | Boley | |
| 5,870,023 | A | 2/1999 | Jackson | |
| 5,877,686 | A | 3/1999 | Ibey et al. | |
| 5,952,921 | A | 9/1999 | Donnelly | |
| 5,973,596 | A | 10/1999 | French et al. | |
| 6,023,225 | A | 2/2000 | Boley et al. | |
| 6,057,756 | A | 5/2000 | Engellenner | |
| 6,057,762 | A | 5/2000 | Dusza | |
| 6,118,376 | A | 9/2000 | Regester | |
| 6,366,205 | B1 * | 4/2002 | Sutphen | 340/568.6 |
| 6,377,175 | B1 | 4/2002 | Williams | |
| 6,407,667 | B1 | 6/2002 | Jackson et al. | |
| 6,411,211 | B1 * | 6/2002 | Boley et al. | 340/568.6 |
| RE37,956 | E | 1/2003 | Blama | |
| 6,696,950 | B2 | 2/2004 | Adolphson | |
| 6,774,792 | B1 * | 8/2004 | Williams | 340/568.6 |

FOREIGN PATENT DOCUMENTS

| | | |
|---|---|---|
| WO | WO 83/04448 | 12/1983 |

* cited by examiner

Sense of club direction is determined by the sequence in whch the sensor coils are activated.

Read Incoming Data Packet
Checksum Valid
N
Y
Serial Number Match
N
Y
Arm Command
Y
Arm System
Send Acknowledge Packet
N
Disarm Command
Y
Disarm System
Send Acknowledge Packet
N
Acknowledge Request
Y
Send Acknowledge Packet
N
MPU Sleep Mode

MISSING GOLF CLUB REMINDER AND WIRELESS GOLF BAG ALARM SYSTEM

BACKGROUND OF THE INVENTION

1. Field of Invention

This invention relates to automatically counting the removal of golf clubs from a golf club bag, and more particularly, to automatically counting and alerting a golfer to the number of golf clubs that have been removed from a golf club bag that need to be restored and automatically alerting the owner of the golf club bag, and even golf grounds personnel, of the non-authorized removal of a golf club from the bag or the bag itself.

2. Description of Related Art

It is usually the practice of a golfer to remove more than one club from their golf bag when considering how to make an upcoming shot. Normally this is done because they are uncertain of what club is appropriate to use. It is then more convenient to have several clubs with them in hand with which to make a selection from than having to walk back to the golf cart for additional clubs. After choosing the correct club to use, the other clubs are placed on the ground. When the shot is made, the golfer may then walk towards the hole to putt the ball in and not realize that he/she left a club on the green. It may then take the golfer several holes later to realize that he/she has forgotten the misplaced club. Furthermore, golf clubs, and even bags, are frequently stolen and easily sold, since they tend to be unmarked. Because golf clubs are so expensive, it is important that golfers have some way to immediately notify them that a theft may be occurring if they are away from their bag.

Misplaced golf club warning devices consist primarily of two types. The first uses a plurality of switches or sensors installed in the bag, which then issue an alarm if one or more clubs are removed. The second type utilize some form of RF (radio frequency) communication from a component either installed in the golf bag or one worn by the golfer which is in contact with a device placed on or in the golf club.

By way of example, in one system using the first type of golf club inventory/reminder device, there are a plurality of cylindrical tubes or openings in a disk that is manufactured into a golf bag at the top opening or further down inside the bag. A sensor consisting of a loaded mechanical switch, and inductive coil or magnetic sensor is located in or around or at the end each receiving member respectively. As a club is removed or replaced, a switch is mechanically unloaded, which then electrically opens or closes a circuit, establishing the presence or absence of a club. Those with magnetic sensors located at the bottom of the plurality of tubes detect the presence or absence of a magnet contained in the grip of the golf club. Further, in yet another method, the presence or absence of a club is determined by the change in the frequency of an electronic oscillator. This is caused by the increase or decrease in the inductance of a tank circuit due to the presence or absence of the ferrous metal golf club shaft, which alters the electrical permeability of an inductive loop that is placed coaxially around each of the plurality of tubes or receiving members. Examples of such systems are shown in U.S. Pat. No. 4,042,918 (Klitzman); U.S. Pat. No. 4,489,314 (Miller); U.S. Pat. No. 5,028,909 (Miller); U.S. Pat. No. 5,565,845 (Hara); U.S. Pat. No. 6,377,175 (Williams). In the systems described above, each golf club must be returned to an individual opening at the top of or in the bag. These inventions require a golfer to pay careful attention when returning a club to the bag and can become a source of annoyance.

The other known systems use active or passive RF (radio frequency) methods to detect when clubs are missing from a golf bag. These systems are further divided into two separate categories: RSSI (received signal strength indication) and RFID (radio frequency identification). RSSI systems rely on the distance between a golfer-carried transceiver and a transceiver contained on or in a golf club. As the golfer travels away from a misplaced club, the strength of the signal received by the golfer-carried device diminishes. When it falls below a threshold, an alarm is sounded to alert the golfer that a club is now some distance from the bag. Unlike an RFID system, the transponder device in the golf club must be powered by an internal battery source.

RFID systems utilize a reader device that generates a low frequency RF near field that illuminates the transponders contained in the bag. This field is rectified into a DC voltage, which powers up the transponders and activates them to communicate to the reader device. When a bag is polled, the present inventory count is stored in memory. At any later time, if the polled count returns a lower number, an alarm is sounded.

These systems use a considerable amount of power and require frequent battery replacement. Also, since these devices consume so much power, they require an on/off switch to conserve batteries when the device is not in use. Because of this, a golfer may forget to activate these systems when on the golf course, which may then result in the loss of a club. Examples of such systems are shown in U.S. Pat. No. 5,952,921 (Donnelly); U.S. Pat. No. 6,118,376 (Regester); U.S. Pat. No. 6,407,667 (Jackson); U.S. Pat. No. 6,057,762 (Dusza); and U.S. Pat. No. 6,366,025 (Sutphen).

Examples of golf bag alarm systems are shown in U.S. Pat. No. 5,041,815 (Newton); U.S. Pat. No. 5,493,274 (Long); U.S. Pat. No. 5,610,585 (Kobe); U.S. Pat. No. 5,783,996 (Musznski); U.S. Pat. No. 5,844,483 (Boley); U.S. Pat. No. 5,870,023 (Jackson); U.S. Pat. No. 5,973,596 (French, et al.); U.S. Pat. No. 6,411,211 (Boley et al.); U.S. Pat. No. 6,696,950 (Adolphson); and U.S. Pat. No. 2,334,801 (Gazeley).

As can be appreciated by one skilled in the art, many of these prior art devices require specialized golf bag designs or inserts to support golf club removal/restoration detection, along with specialized components mounted to or within the golf club itself. The direct mounting of the components of the known systems on the golf clubs have required some damage or defacement to the golf clubs. Further, adding new clubs to the player's collection requires that a component be mounted on each added club for the system to be functional with respect to the added club. Also, any clubs that are replaced or otherwise removed from the collection must have the component removed from the club, or a new component must be obtained for the replacement club. Such component mounting directly on the club thus makes it difficult to add or subtract clubs from the collection if the system is to operate with respect to all clubs of the collection. And since typically the system component is mounted on the tip of the club grip, the system component is vulnerable to damage if the club is dropped on the tip of the club grip. Furthermore, many of these devices employ a continuous transmission of signals that consume large amounts of power which, in turn, requires bulky batteries or short operational periods of time. As a result, the device also includes an on/off switch to save power; however, the presence of the on/off switch introduces a failure mode in that the user may forget to turn the device on, thereby defeating the purpose; or in the alternative, forget to turn the device off, thereby resulting in an inoperative device well before its useful lifetime.

Thus, there remains a need for a device that can be easily coupled to any conventional golf bag and conventional golf clubs without damaging or defacing them, that automatically counts the number of golf clubs removed from the golf club bag while using low power, that automatically informs the user of the number of golf clubs that need to be restored to the golf club bag, that automatically alerts the user, either locally or remotely, that at least one club has not been restored, and which also can provide automatic alerts to the golf bag owner, or golf grounds personnel, as to unauthorized contact with the golf bag and/or its contents.

All references cited herein are incorporated herein by reference in their entireties.

BRIEF SUMMARY OF THE INVENTION

An apparatus for automatically counting golf clubs removed from a conventional golf club bag and automatically alerting the user that the number of removed golf clubs have not been returned to the conventional golf club bag. The apparatus comprises: a detector disposed around the opening of the conventional golf club bag for generating a signal when the golf club is moved through the opening of the bag; a tag coupled to each of the golf clubs that is detected by the detector when any of the golf clubs is moved through the opening of the bag; and a controller, coupled to the detector, that is activated by receipt of the signal and wherein the controller processes the signal and controls a display indicating the number of golf clubs removed from the bag.

An apparatus for providing an indication as to the unauthorized contact or movement of a golf club bag. The apparatus comprises: a motion detector coupled to the bag for emitting motion detector signals whenever the bag is experiencing motion; a first transmitter, coupled to the motion detector, for emitting a wireless signal whenever the motion detector emits the motion detector signals; and a first receiver associated with a person who has authorized control of the bag, wherein the receiver has an indicator and wherein the indicator is activated whenever the first receiver receives the wireless signal.

A system for providing an indication as to the unauthorized contact or movement of at least one golf bag from a plurality of golf club bags positioned on golf course grounds that include a structure having a video camera or audio alarm equipment. The system comprises: a respective motion detector coupled to each one of the plurality of bags for emitting respective motion detector signals whenever each one of the plurality of bags is experiencing motion; a respective transmitter, coupled to each one of the respective motion detectors, for emitting respective wireless signals whenever the respective motion detector emits the respective motion detector signals; a receiver secured to the structure, wherein the receiver is coupled to the video camera or audio alarm equipment and activates the video camera or audio alarm equipment whenever the receiver receives at least one wireless signal.

A method for automatically detecting the removal of a golf club from a conventional golf club bag and automatically providing a count of the golf clubs that have not been restored to the bag. The method comprises the steps of: coupling a tag to each golf club in the conventional golf club bag; disposing a detector around the opening of the bag which generates a signal each time a golf club, including a tag, is moved through the opening; activating a controller by the signal which then processes the signal; and controlling a display, by the controller, to indicate the number of golf clubs removed from the bag.

A method for providing an indication as to the unauthorized contact or movement of a golf club bag. The method comprising the steps of: coupling a motion detector coupled to the bag for emitting motion detector signals whenever the bag is experiencing motion; emitting a wireless signal whenever the motion detector emits the motion detector signals; activating a remotely-located indicator associated with a person who has authorized control of the bag whenever the wireless signal is received by a remotely-located receiver coupled to the remotely-located indicator.

A method for providing an indication as to the unauthorized contact or movement of at least one golf bag from a plurality of golf club bags positioned on golf course grounds that include a structure having a video camera or audio alarm equipment. The method comprises the steps of: coupling a respective motion detector to each one of the plurality of bags for emitting respective motion detector signals whenever each one of the plurality of bags is experiencing motion; emitting respective wireless signals whenever the respective motion detector emits the respective motion detector signals; activating the video camera or audio alarm equipment whenever a receiver, coupled to the video camera or audio alarm, receives at least one wireless signal.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

It should be understood that the following disclosure is for a golf club counting device but that it is within the broadest scope of the present invention to cover any device that can count the number of objects removed from a specified location with the understanding that the objects are to be returned to the specified location after use. For example, a tool removed from a tool chest, a tool/machine from a desk drawer, an article of clothing from a dresser, etc.

The present invention 20 (FIG. 1) counts and displays the number of golf clubs that have been removed from a golf club bag. Further accessories of the present invention 20 include a pager 20A (FIGS. 2 and 3) and a monitor receiver 20B (FIG. 2) that the present invention 20 communicates with in order to alert the golf club/golf bag owner, at a remote location, or even golf grounds personnel, that at least one golf club in his/her bag, or the bag itself, is being moved without authorization. The pager 20A can also provide the golfer with a remote indication of "forgotten clubs." The details of the pager 20A and the monitor receiver 20B will be discussed later. Thus, the present invention 20, pager 20A and monitor receiver 20B form a system that provides a valuable means of property protection and increases the peace of mind of those golfers who must leave their bags unattended on or off a golf cart in a physically unguarded location, such as while they are in a restaurant, clubhouse, parking lot, or other such area.

Figure 1:
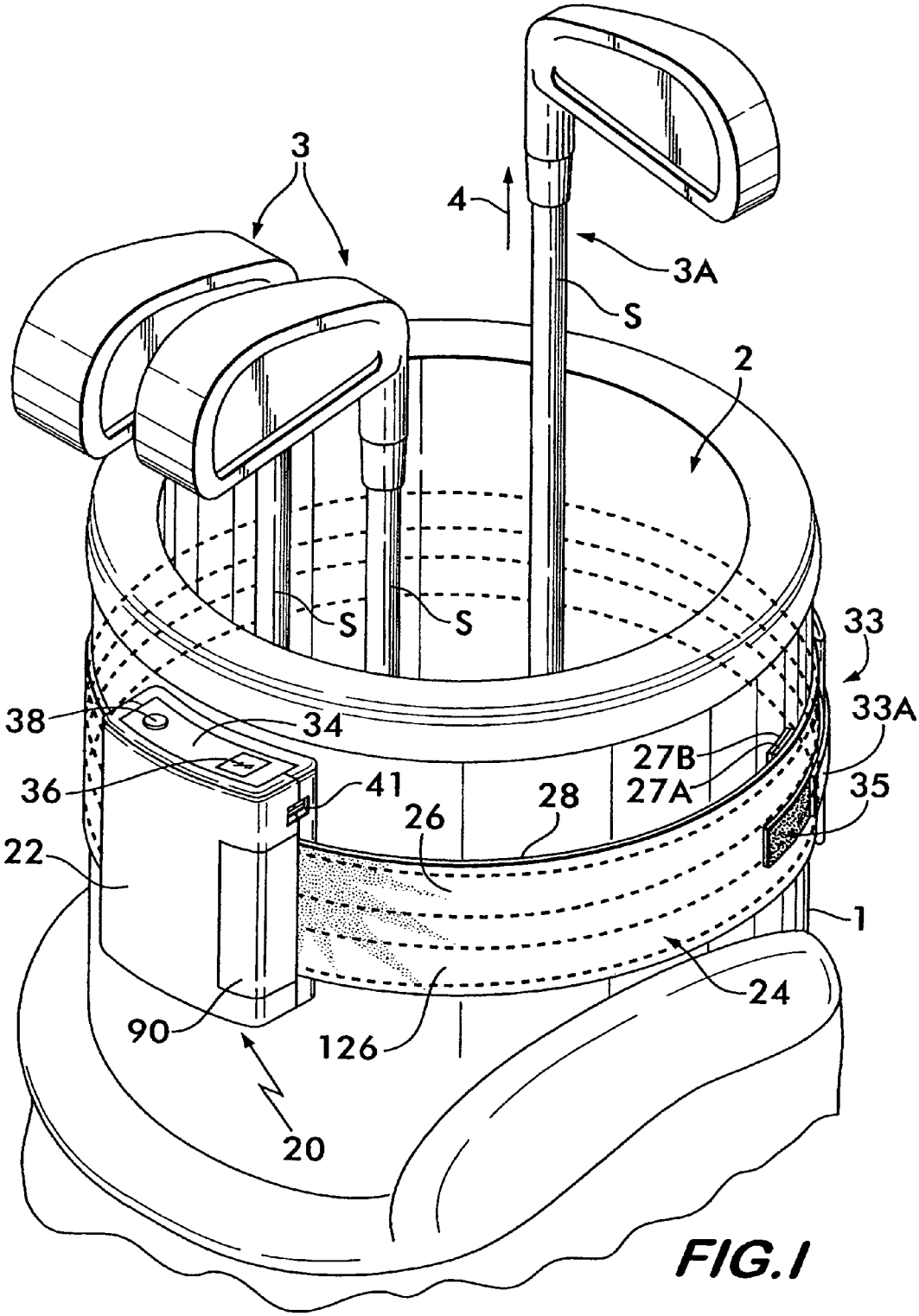
FIG. 1 is an isometric view of the present invention shown coupled around the opening of a conventional golf club bag, shown partially, having a plurality of clubs therein, with one being removed.
Figure 2:
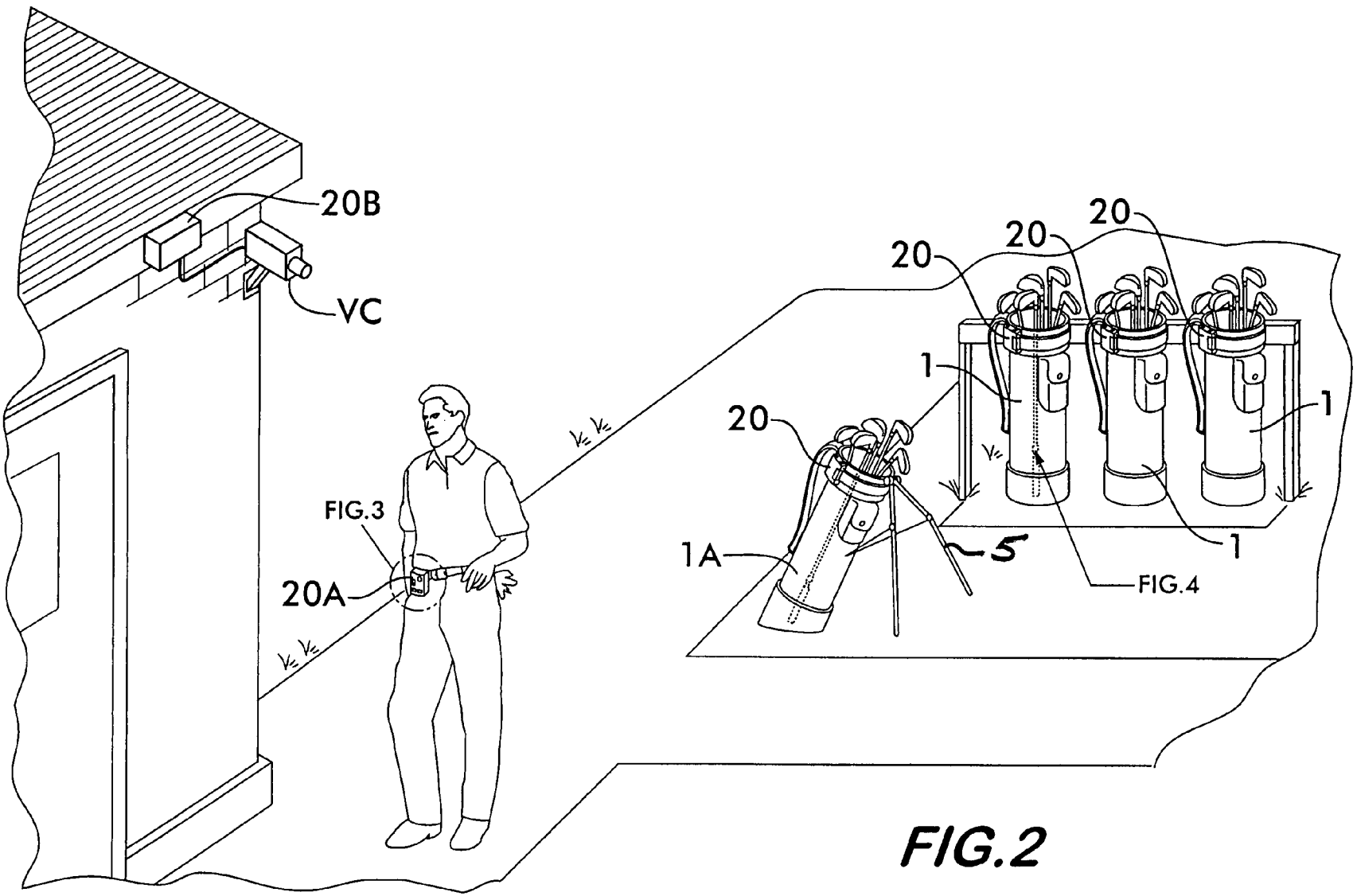
FIG. 2 depicts the present invention being used in conjunction with a pager and a monitor receiver for remotely alerting the golf club bag owner, or country club personnel or public golfing personnel, about unauthorized contact with the golf club bag or clubs.

FIG. 1 shows the present invention 20 coupled around the opening 2 of a conventional golf club bag 1 having a plurality of golf clubs 3. The invention 20 comprises an enclosure 22 and a sensor belt assembly 24. As shown most clearly in FIG. 4A, the sensor belt assembly 24 comprises a first ribbon cable 26 and a second ribbon cable 126 that are contained inside a belt covering (e.g., a nylon tube belt cover) 28. Each ribbon cable comprises IDC (insulation displacement connectors) 30A/30B (see FIG. 4A) and 130A/130B, respectively, that are electrically coupled inside the enclosure 22, as will be discussed later. When coupled to the golf club bag 1, each of these ribbon cables forms a closed circle or "coil" that form a "magnetic pickup loop"; the first ribbon cable 26 is located at a higher elevation than the second ribbon cable 126 and thus the first ribbon cable 26 and second ribbon cable 126 are also referred to as "top sense coil" and "bottom sense coil," respectively. By way of example only, these two coils may be vertically spaced approximately two inches apart. Thus, as will be discussed later, when a golf club (see club 3A in FIG. 1 and direction of removal indicated by arrow 4) is removed from the opening 2 of the golf club bag 1, the bottom sense coil 126 detects the removal first, followed by the top sense coil 26; conversely, when the golf club 3 is returned to the golf club bag 1, the top sense coil 26 detects the golf club first, followed by the bottom sense coil 126.

As will be discussed below, the present invention 20 is easy to install, use and operate. It can be adjusted to fit any size golf bag, including golf bags that use a stand. The present invention 20 is small, unobtrusive and lightweight (e.g., less than 2 ounces). The sensor belt assembly 24 also comprises means for releasably securing the present invention 20 to the conventional golf bag 1. Where a golf bag 1A includes a stand 5 (see FIG. 2), the present invention 20 includes a detachable connector 90 that allows one end of the belt assembly 24 to be dis-engaged from the housing 22, to be positioned around the periphery of the golf bag 1A and through the stand 5 structure, and then re-connected to the housing 22.

Figure 4A:
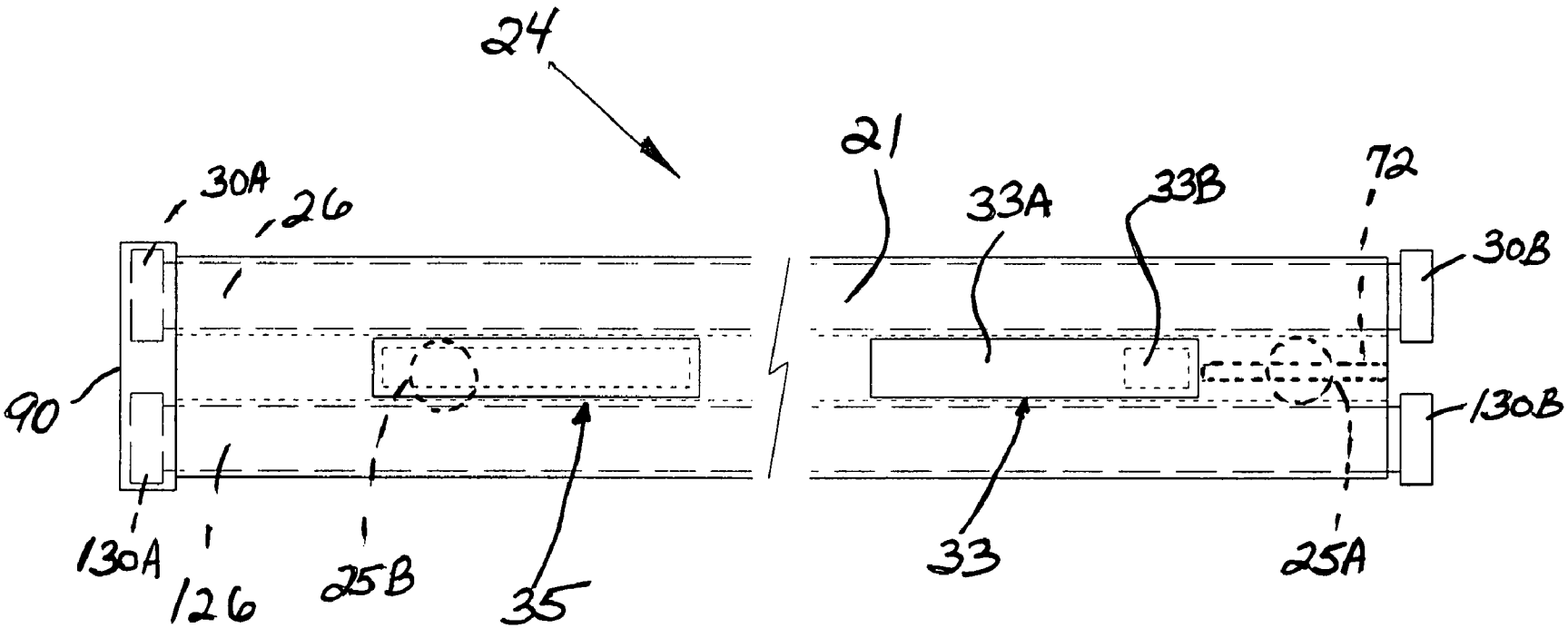
FIG. 4A is a partial plan view of the sensor belt assembly portion of the present invention with the enclosure not shown.
Figure 4B:
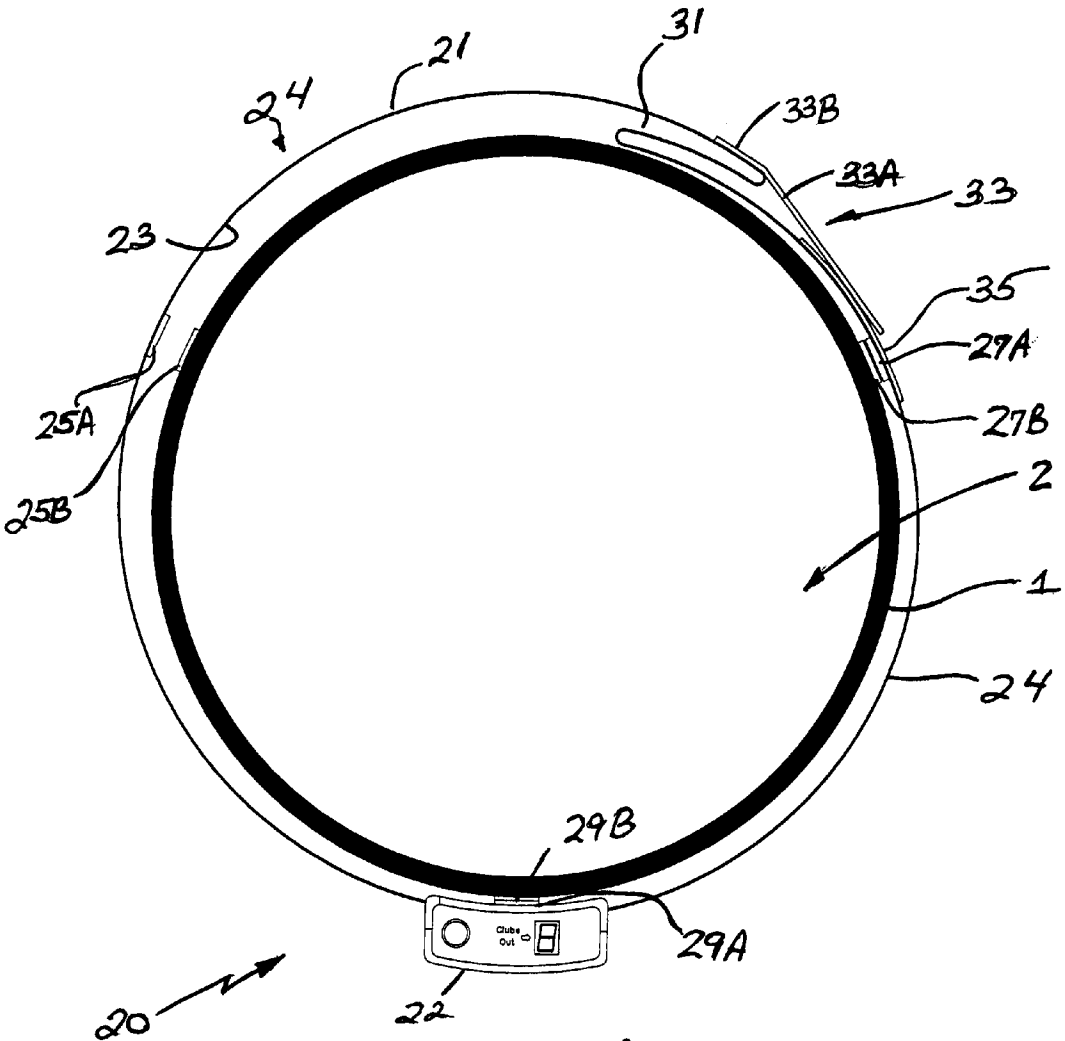
FIG. 4B is a top view of the present invention shown coupled to the opening of a conventional golf club bag.

By way of example only, as can be seen most clearly in FIG. 4B, the belt assembly 24 comprises an outer surface 21 and an inner surface 23. On the inner surface 23 there are releasable securement means 25A and 27A (e.g., VELCRO® tags sold under the tradename VELCOIN®) that mate with corresponding releasable securement means 25B and 27B (e.g., VELCRO® tags sold under the tradename VELCOIN®) which are applied/attached to the outside of the golf bag opening 2; the back side of the enclosure 22 also includes a releasable securement means 29A (e.g., VELCRO® tag sold under the tradename VELCOIN®) that mates with a corresponding releasable means 29B (e.g., VELCRO® tag sold under the tradename VELCOIN®) which is also applied/attached to the outside of the golf bag opening 2. When the present invention 20 is to be coupled to the opening of the golf bag 1, the corresponding releasable means 25B, 27B and 29B are first applied (e.g., an adhesive on the back sides thereof) preferably at the 10 o'clock, 2 o'clock and 6 o'clock positions around the opening 2 of the golf bag 1, as shown in FIG. 4B. The present invention 20 is passed down around the opening 2 of the golf bag 1 and the enclosure 22 is pressed against the releasable securement means 29B and the sensor belt assembly 24 is pressed against the releasable securement means 25B and 27B. Since the sensor belt assembly 24 is slightly oversized to fit around any conventional golf club bag 1, to remove any slack 31, a synch strap 33 and a tie down strap 35 are provided; the synch strap 33 (e.g., VELCRO® synch strap) comprises a free end 33A and a fixedly-secured end 33B. In particular, with the present invention 20 now releasably coupled to the golf club bag 1 at the releasable securement means 25A/25B, 27A/27B and 29A/29B, the user loops the slack 31 and pushes it under another portion of the belt assembly 24, as shown in FIG. 6. The user then seizes the free end 33A of the synch strap 33 and pulls it taught and then presses it against the tie down strap (e.g., VELCRO® tie down strap) 35. The present invention 20 is now releasably secured to the golf club bag opening 2.

Figure 5:
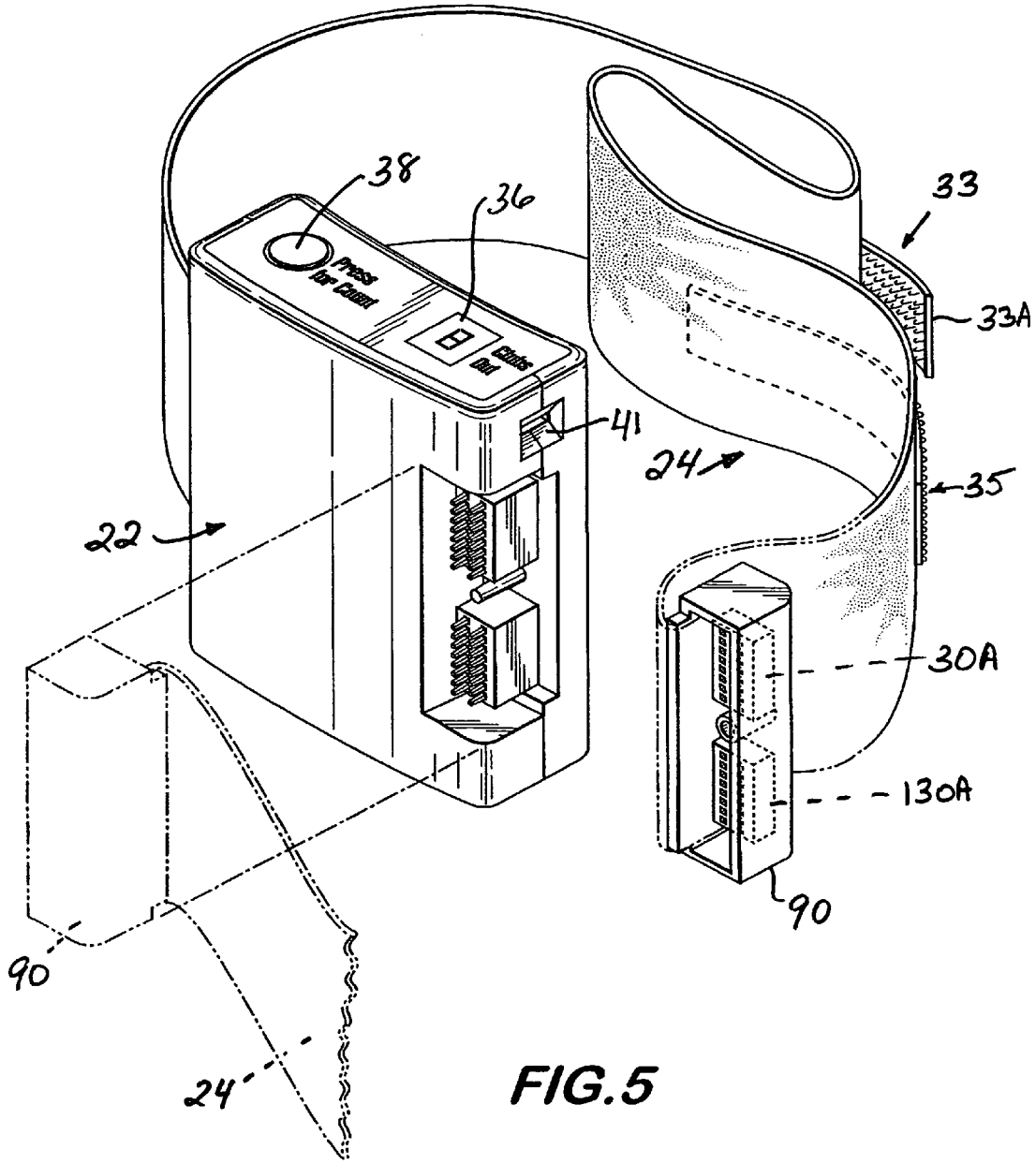
FIG. 5 is an isometric view of the present invention showing the detachable connector of the belt assembly disengaged from the present invention and showing, in phantom, how to align the detachable connector for connection to the present invention.

Alternatively, where the golf bag 1A includes the stand 5 (FIG. 2), one end of the belt assembly 24 needs to be dis-engaged from the housing 22 initially (FIG. 5). This permits the belt assembly 24 to be slid through the stand 5 structure, near the opening 2 of the golf bag 1A. Once the connector 90 of the belt assembly 24 is fed through the stand structure and around the golf bag opening 2, the connector 90 can be re-connected to the housing 22. Once the connector 90 is coupled to the housing 22, the present invention 20 can be releasably secured around the opening 2 of the golf bag 1A using the releasable securement means 25A/25B, 27A/27B and 29A/29B described previously and adjustment of the slack in the belt assembly 24 can be made using the synch strap 33, as also described previously.

It should be understood that any further discussion regarding the golf bag 1 includes the golf bag 1A which comprises the stand 5 and that once the present invention 20 is attached to either golf bag 1 or 1A, operation of the present invention 20 is the same.

Figures 3, 4:
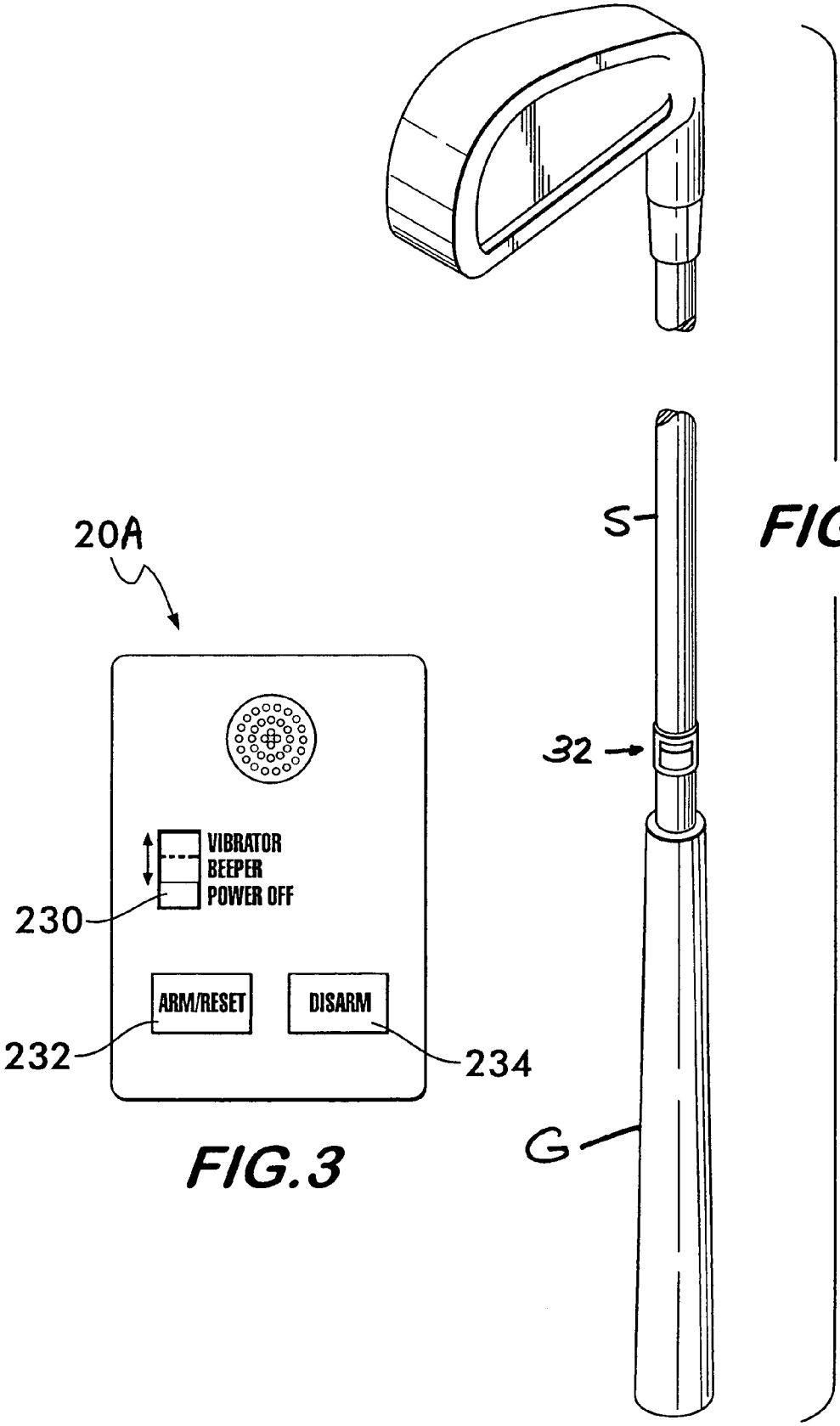
FIG. 3 is front view of a pager portion of the present invention.
FIG. 4 is a conventional golf club, shown partially, having the sensor tag coupled to the golf club shaft.
Figure 7:
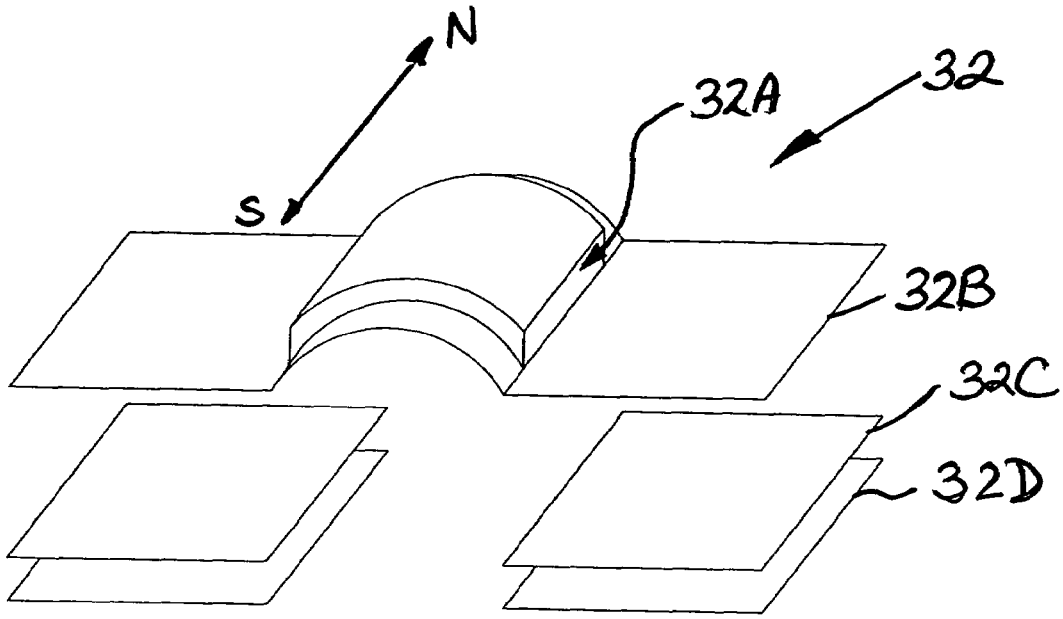
FIG. 7 is an enlarged exploded view of the sensor tag of the present invention.

As shown in FIG. 4, a sensor tag 32 is coupled to the shaft S of each golf club 3 near the lower end of the club grip G. The sensor tag 32 (FIG. 7) is lightweight and does not interfere with the use of the golf club 3 during play. As shown in FIG. 7, the sensor tag 32 comprises a rectangular-shaped magnet 32A (e.g., a Grade N30 Neodymium iron boron magnet), arcuate in cross-section, that is vacuum-formed in a thermoplastic overlay 32B which is bonded to pressure sensitive adhesive base strip 32C which is covered by a removable adhesive backing cover 32D. The arcuate cross-section feature of the magnet 32A aids in maintaining the magnet 32A securely against the club shaft S while maintaining a streamlined shaft contour. Movement of the golf club/sensor 32 in/out of the top of the golf club bag 1 induces voltages in the coils 26/126, as will be discussed later. It should be noted that if it is the habit of the golfer to pull more than one golf club simultaneously out of the bag, the golfer is instructed to stagger the location of mounting the sensor tag 32 on the shaft S (e.g., at least two inches apart on the shaft S). The sensor tags 32 used in the present invention 20 work on metal or non-metal composite golf clubs. In contrasts, existing golf club counting devices use the permeability of a ferrous metallic shaft placed in an inductive loop or sensing gap to determine the present or absence of a golf club by the change of an oscillator or the capacitance change inside a sensor gap. The detection mechanisms of these designs thereby limit their use to only metal-shafted clubs. In addition, the sensor tags 32 form a "passive tag" in that the sensor tag does not require a power source (e.g., a battery) to be effective.

Figure 6A:
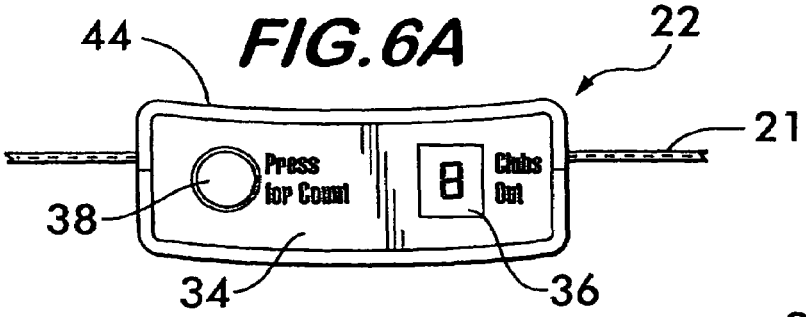
FIG. 6A is a top view of the enclosure portion of the present invention.
Figure 6B:
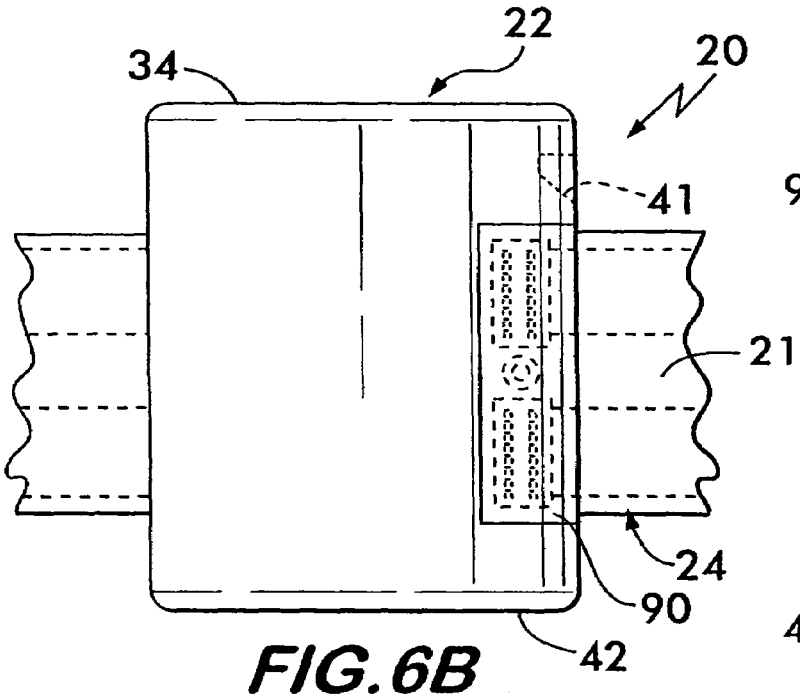
FIG. 6B is front view of the enclosure portion and a partial view of the sensor belt assembly of the present invention.
Figure 6D:
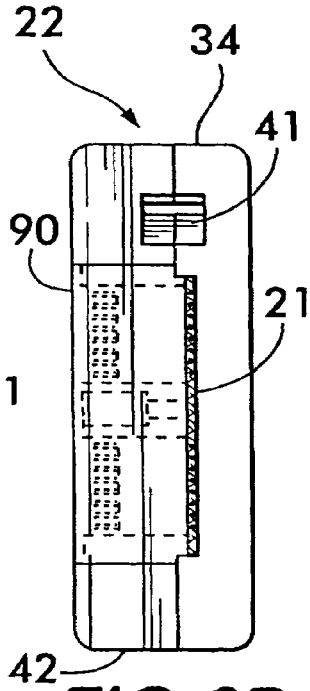
FIG. 6D is a side view of the enclosure portion of the present invention.
Figure 6C:
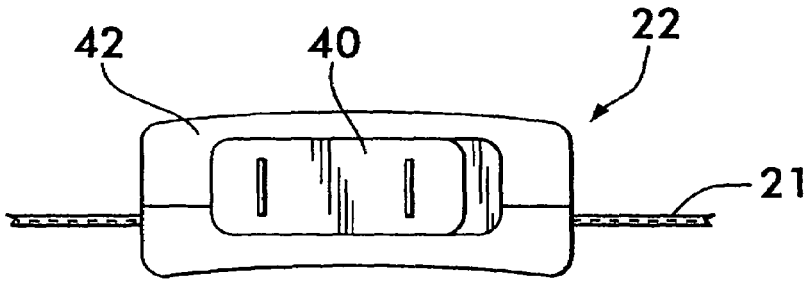
FIG. 6C is a bottom view of the enclosure of the present invention.

As shown in FIGS. 6A–6D, the enclosure 22 comprises a top surface 34 which includes a display 36 (e.g., a Vishay TDSL3150 seven segment LED display) for displaying the number of golf clubs removed from the golf club bag 1 and not returned; the top surface 34 also comprises a switch 38 (e.g., E-Switch TL1105BF250Q SPST momentary switch) that provides the user with several functions, all of which will be discussed later. The bottom surface 42 of the enclosure comprises a battery access door 40 that can be removed by the user for replacing the batteries. As can be seen in FIG. 6A, the back surface 44 is curved to permit the enclosure 22 to fit snugly around the opening of the golf club bag 1.

Figure 8:
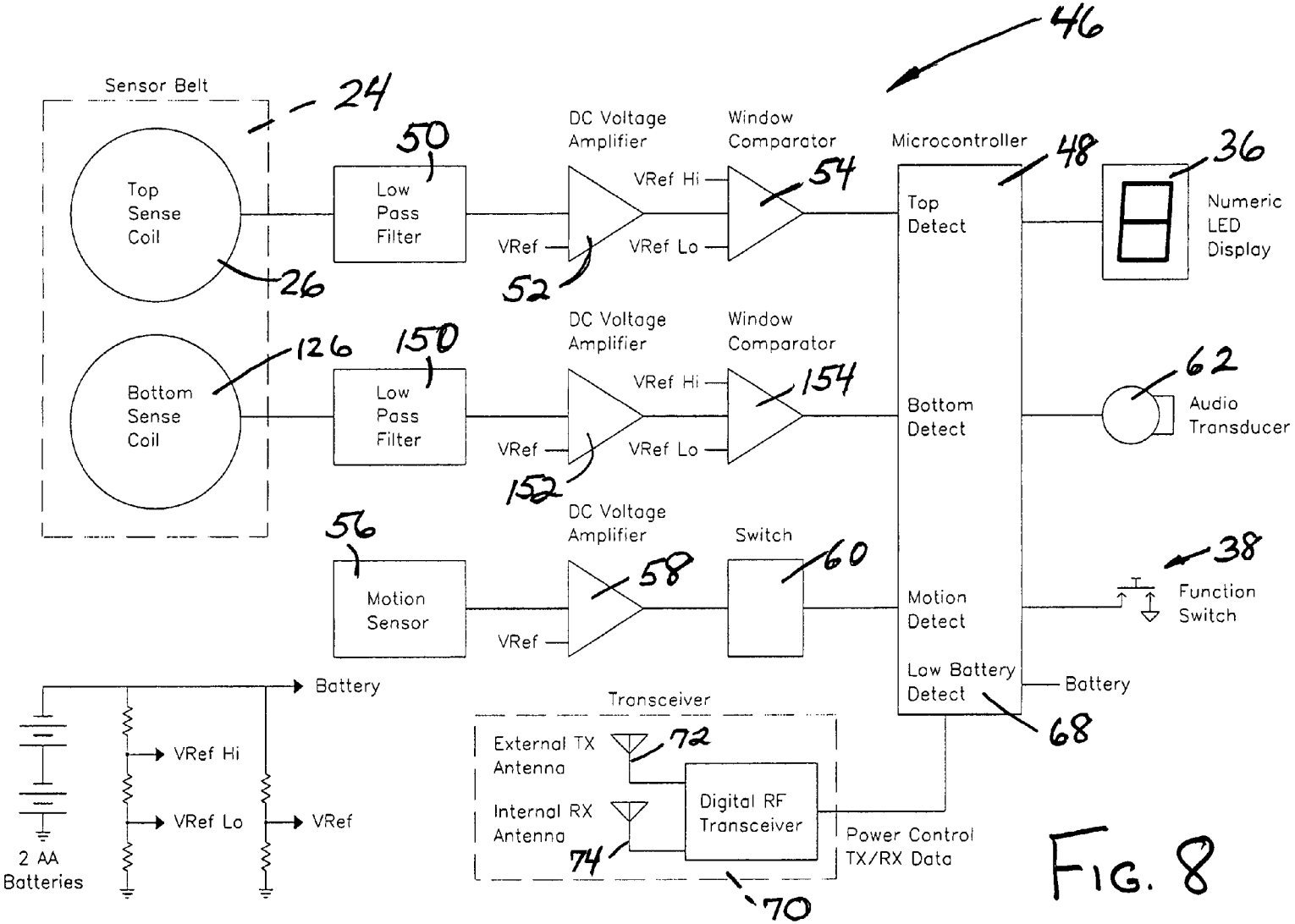
FIG. 8 is a block diagram of the electronics of the present invention including a schematic of the DC reference voltages.

FIG. 8 is a block diagram of the electronics 46 of the present invention 20. In particular, each of the coil sensors 26/126 are coupled to respective sensor paths that feed the respective sensor signals to a microcontroller 48 (e.g., Motorola MC9S08RC8CFJ 8-bit, 8K flash, 32 pin LQFP microcontroller). A motion sensor 56 and its corresponding feed path to the microcontroller 48 is also shown. The electronics of the present invention 20 also include a transceiver 70 for communicating with the pager 20A and monitor receiver 20B. Finally, a power supply schematic is provided in FIG. 8 which shows an exemplary power source (e.g., 2 AA batteries) that powers the electronics 46 and which provides the indicated reference voltages. The present invention 20 requires no user-activated on/off switch. The device 20 is always powered on, consuming only several microamps of current. At this level of current drain, electrical loading of the batteries approaches that of shelf-life leakage conditions. This feature eliminates the possibility of the golfer forgetting to turn the device 20 on prior to use and losing a club 3. When a club passes through the bag opening 2 or when motion is detected, the microcontroller 48 comes out of a "sleep" state to an active state and displays a count or determines if a club 3 is removed or out of the bag and if it is necessary to sound an alarm. Among other things, it is this ability of the microcontroller 48 to be "activated" from a "sleep" state that low power consumption is achieved. In contrast, should the user of any existing golf club reminder devices forget to turn off his/her device after use, the batteries will be depleted sooner than normal and require earlier replacement.

Figure 9A:
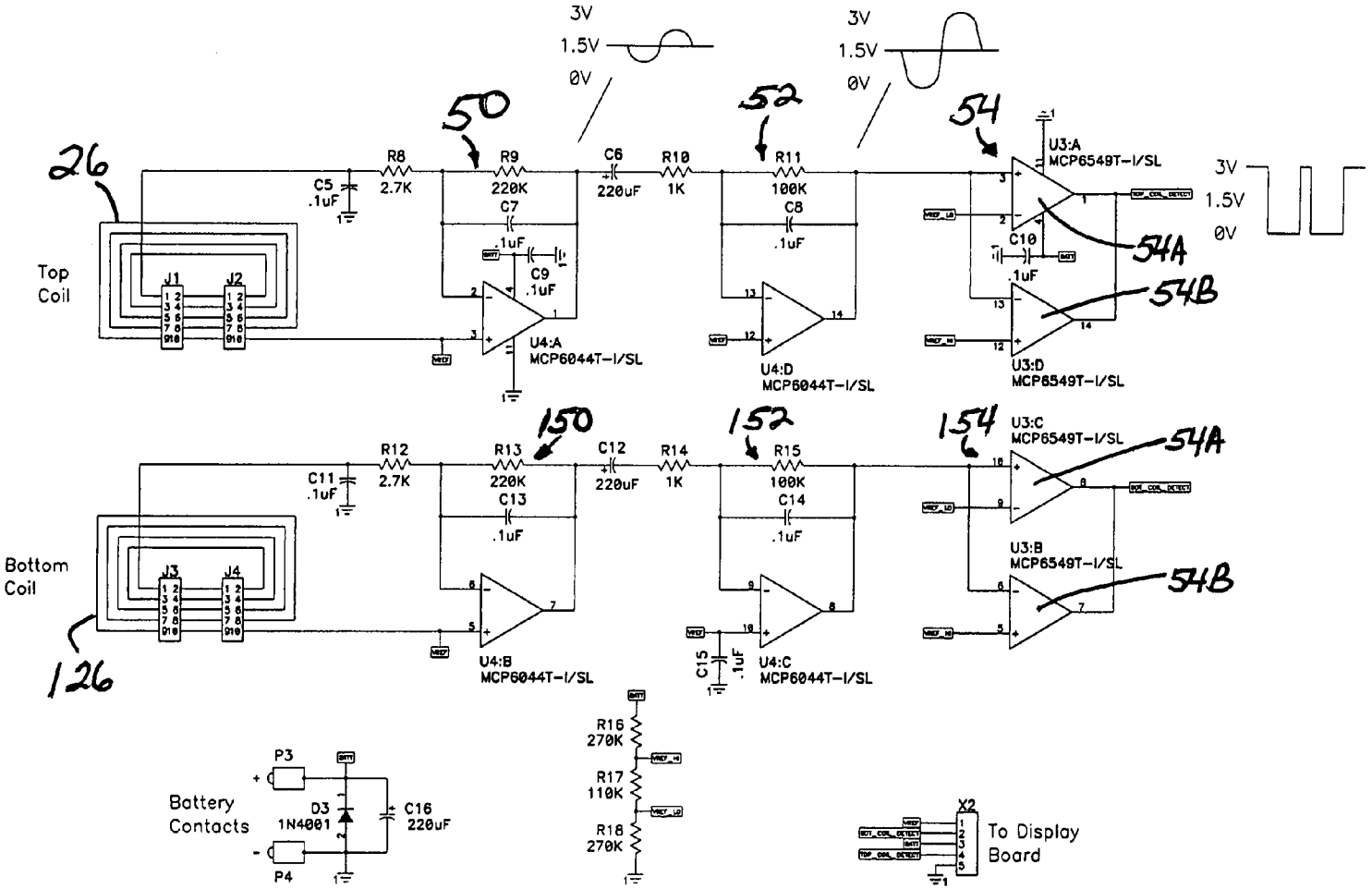
FIG. 9A is an electrical schematic diagram of the sensor coil paths.

FIG. 9A is an electrical schematic of the respective coil sensor processing paths. The top coil ribbon cable ends 30A and 30B are electrically connected to circuit card connectors J1 and J2 respectively; similarly the lower coil ribbon cable ends 130A/130B are electrically connected to circuit card connectors J3/J4 respectively. If the sensor tag 32 passes through a respective coil 26/126, a low frequency bipolar pulse voltage is momentarily induced in the coil 26/126. To prevent high frequency sources, e.g., radios, cell telephones, other RF signal sources, etc., from passing induced voltages in those coils 26/126 to the microcontroller 48, low pass filters 50/150 are provided. The low frequency bipolar pulse voltage, induced by the sensor tag 32, passes through the filters 50/150 and is amplified by an amplifier stage 52/152.

Figure 9B:
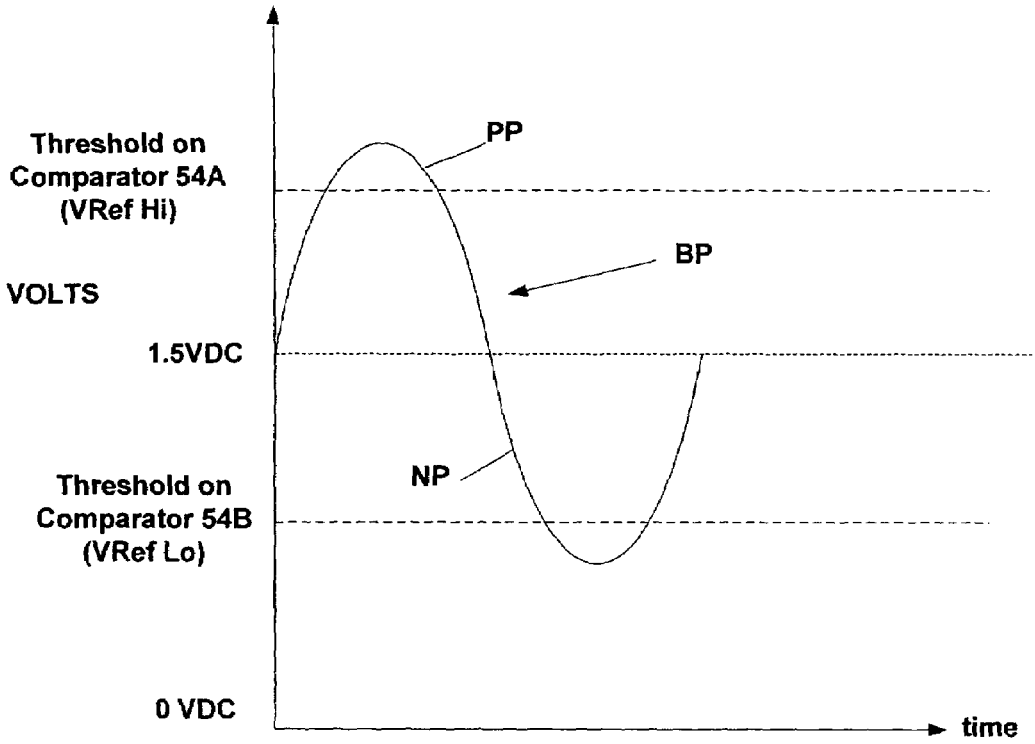
FIG. 9B is an exemplary signal diagram of the bipolar pulse induced in the sensor coil by movement of the magnet of the sensor tag through the sensor coil with the magnet having a first north-south orientation on the golf club.
Figure 9C:
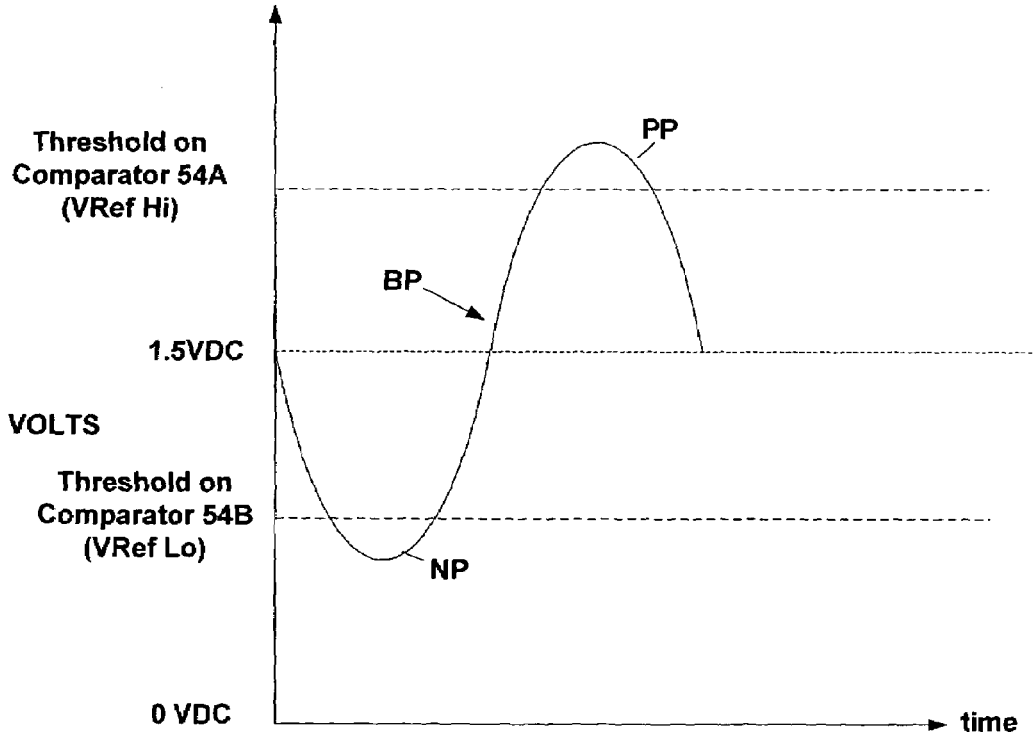
FIG. 9C is an exemplary signal diagram of the bipolar pulse induced in the sensor coil by movement of the magnet of the sensor tag through the sensor coil with the magnet having a second north-south orientation on the golf club.

The amplified bipolar pulse signal BP is then passed to a window comparator stage 54/154. The window comparator comprises a pair of wired-OR open drain comparators 54A/54B (e.g., MCP6549T-I/SL comparator), as shown most clearly in FIG. 9A. The dualized comparators 54A/54B permit the detection of the sensor tag 32 regardless of the orientation of the rod magnet 32A therein on the golf club. Depending on how the magnet 32A is oriented on the golf club shaft S, e.g., north pole up or north pole down, the bipolar pulse signal BP generated will have a different phase. When a club 3A is being removed from the bag 1, flux lines of the magnet 32A first induce a voltage in the bottom ribbon cable 126 and then in the top ribbon cable 26. Conversely, when a club 3 is being restored to the bag 1, flux lines of the magnet 32A induce a voltage in the top ribbon cable 26 first and then in the bottom ribbon cable 126. In particular, the bipolar pulse BP has a positive-going portion PP and a negative-going portion NP. For simplicity and by way of example only, one type of bipolar pulse BP is a sinusoidal pulse, as shown in FIGS. 9B and 9C, depicting two exemplary sinusoidal pulses, and reflecting different orientations of the magnet 32A (i.e., north pole up or north pole down, respectively). However, it should be understood that the bipolar pulse signal BP does not have to have the symmetry or smoothness of a sinusoidal pulse which is shown only by way of example.

The positive-going portion PP and the negative-going portion of the bipolar pulse BP is detected by a respective comparator. Thus, the positive-going portion PP is detected by comparator 54A if the amplitude of that positive-going portion PP exceeds the upper threshold (VRef Hi) on comparator 54A; similarly, the negative-going portion NP is detected by comparator 54B if the amplitude of that portion exceeds the lower threshold (VRef Lo) on comparator 54B. Where a metal shaft golf club is used (as opposed to a graphite club) and to which the sensor tag 32 is attached, part of the magnetic flux from the magnet 32A is distorted by the ferrous material therein. As a result, the bipolar pulse signal BP may not be symmetrical about the reference voltage (e.g., 1.5VDC); thus, the amplitude of each portion PP/NP may be different. In contrast, where a graphite golf club is used, the magnetic flux of the magnet 32A is not distorted and a low frequency sinusoidal pulse is generated, such as those shown in FIGS. 9B–9C. Each comparator 54A/54B is active in a low state, meaning that if the respective threshold voltage (VRef Hi, VRef Lo) is exceeded by the corresponding portion PP/NP, the output of the comparator 54A/54B is a low pulse signal. Thus, detection of a sensor tag 32 is characterized by the comparator 54/154 sending a low pulse to the microcontroller 48.

Figure 9D:
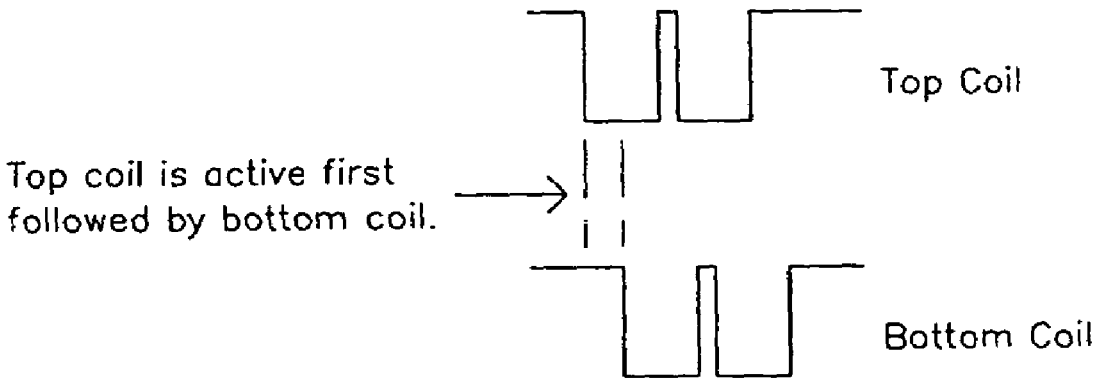
FIG. 9D is a timing diagram showing how the microcontroller detects whether a golf club is being removed from, or restored to, the golf club bag.
Figure 9D:
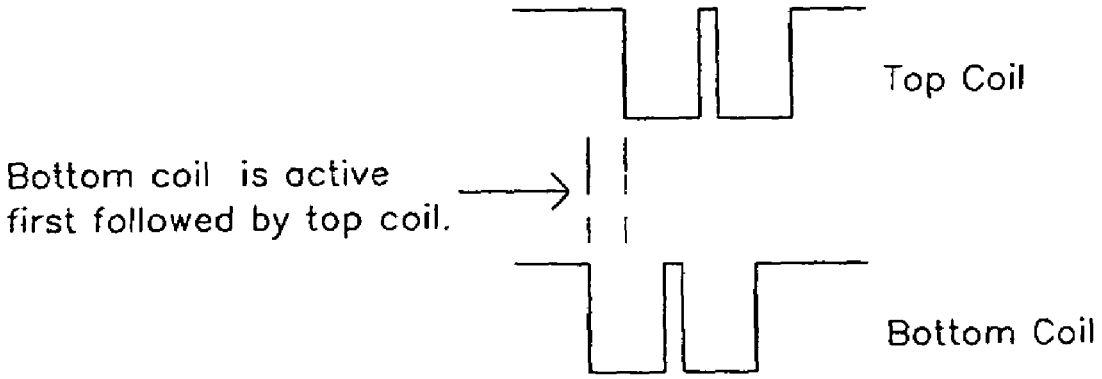

As can be appreciated, each coil 26/126 is able to accurately detect the presence of the sensor tag 32 as it passes therethrough. Thus, depending on which comparator 54/154 sends the low pulse first to the microcontroller 48, the microcontroller 48 is able to detect if the golf club 3 is being removed from the golf club bag 1 or restored therein. FIG. 9D depicts a timing diagram regarding this operation.

Figure 9E:
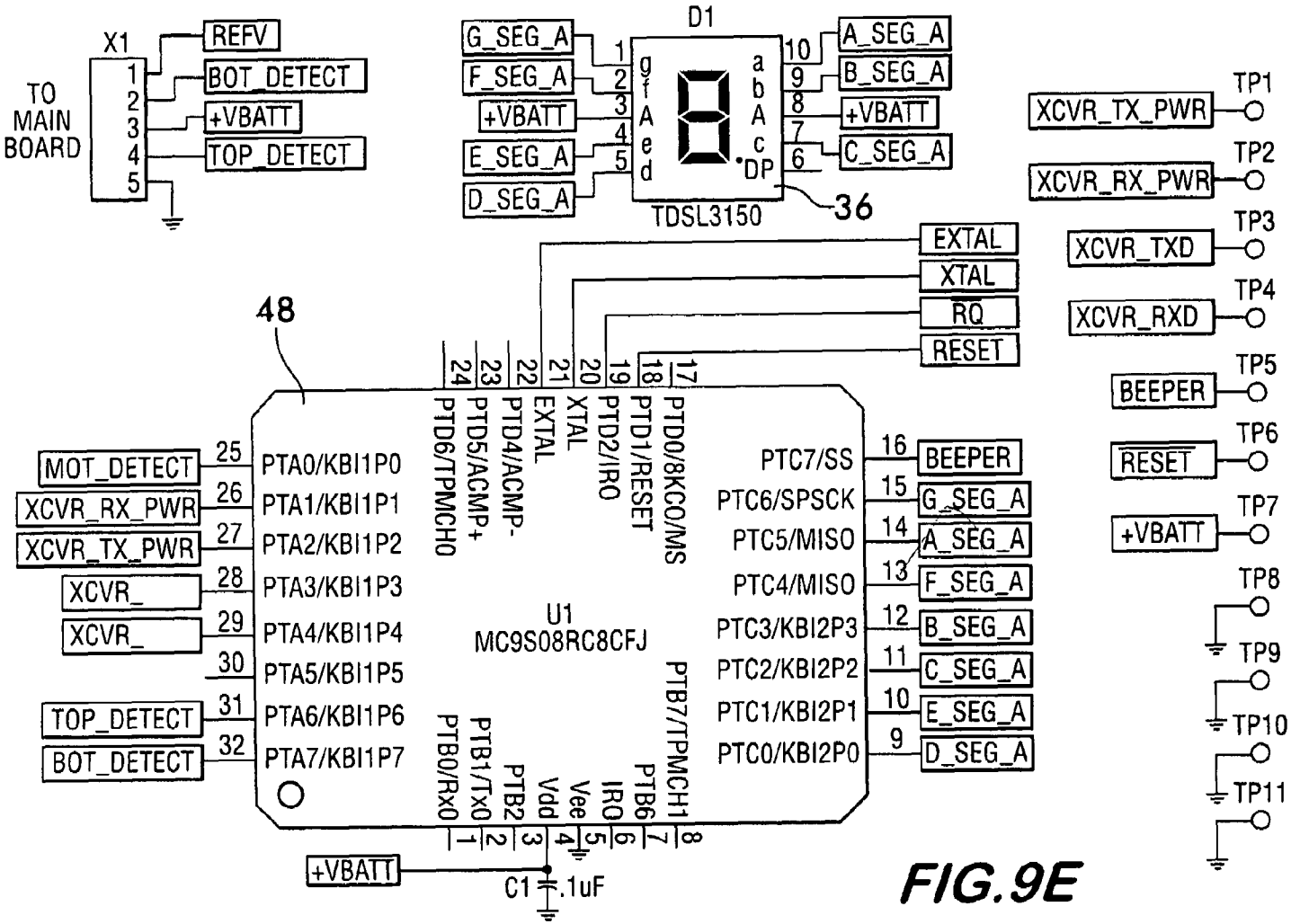
FIG. 9E is an electrical schematic of the motion sensor, the microcontroller, the display and the beeper of the present invention.
Figure 9E:
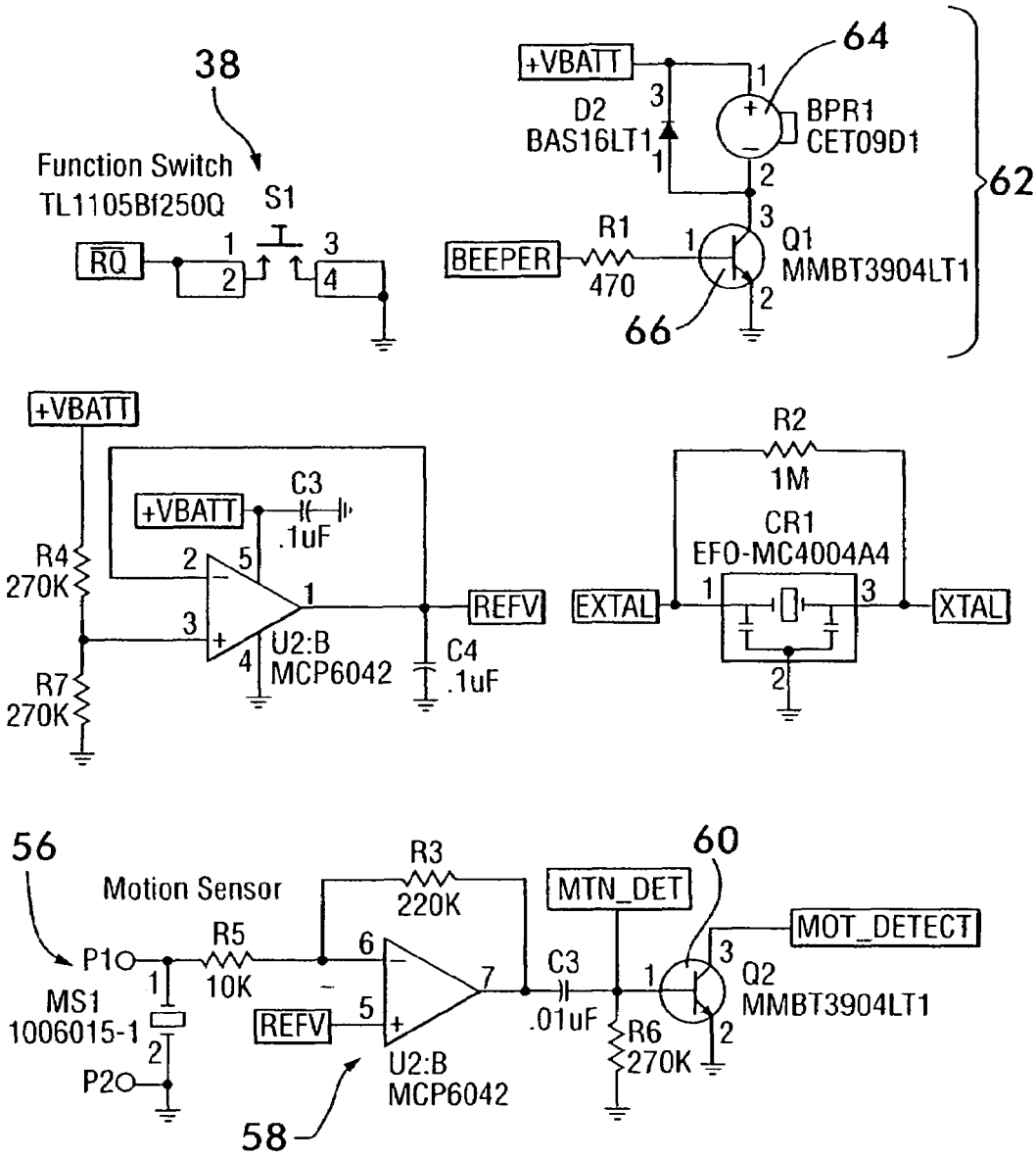

In addition to the top and bottom sense coils 26/126, the present invention 20 also includes a motion sensor 56 (FIG. 8), located within the enclosure 22, that detects sustained motion, e.g., the golf club bag 1 is being moved such as when the player is walking away, or driving away, with the bag 1 to the next hole, thereby forgetting to retrieve any golf clubs 3 that were left on the ground at the previous hole. The motion sensor 56 (e.g., MS11005939-1) may comprise a cantilevered element that emits an alternating voltage signal whenever the golf club bag 1 (to which the present invention 20 is attached) is moved. This alternating voltage signal is fed to an amplifier stage 58 whose output is passed through a switch 60 and then fed to the microcontroller 48. As shown in more detail in FIG. 9E, the alternating voltage signal from the motion sensor 56 is fed through the amplifier stage 58 whose output turns on/off a transistor 60, whose collector is tied high when off. When the alternating voltage signal turns on/off the transistor 60, pulse train signal MOT_DETECT is sent to pin 25 of the microcontroller 48. If this pulse train signal MOT_DETECT is sustained for approximately 10–15 seconds and the missing number of golf clubs is not zero, the microcontroller 48 issues a BEEPER command from pin 9 to an audio transducer 62. The audio transducer 62 may comprise a beeper 64 (e.g., BPR1 CET09D2 magnetic audio transducer) that is coupled to battery power at one end and coupled through transistor 66 to ground. The BEEPER command from the microcontroller 48 comprises a pulse train that toggles the transistor 66 on/off, thereby causing the beeper 64 to emit audible beeping sounds for the duration of the BEEPER command, thereby warning the player that he/she has left the golf clubs somewhere and not returned them to the bag 1.

Another important feature of the present invention 20 is the automatic check of battery power. In particular, the microcontroller 48 comprises low battery voltage detection circuitry 68 (FIG. 8) that provides the golfer with an indication that the batteries require replacement. Any time that the display 36 is activated by the microcontroller 48, the low battery voltage detection circuitry 68 checks the battery power level and if that level is at or below a predetermined threshold (e.g., ½ battery supply voltage, 1.8 VDC), the golfer is warned well in advance of the present invention 20 becoming inoperable due to lack of battery power, e.g., a short audible reminder sounds every hour that the present invention is in use. In addition, supplementing the audible low battery warning, the display 36 displays sequential characters "L", "0" "b" to provide a visual warning of "low battery." Thus, the audible low battery warning (e.g., emitted hourly) draws the attention of the golfer to the display 36 which makes it clear that the audible warning is for a low battery condition; this is very helpful in that, over time, the golfer may have forgotten what the particular audible warning is directed to. In contrast, no existing golf club counting devices, to the best of Applicant's knowledge, provide any means to test batteries or provide an early warning signal to the user that the batteries will soon need replacement.

The function switch 38 provides several user functions. The function switch 38, if momentarily depressed, informs the golfer how many clubs 3 have not been restored to the bag. The second function allows the resetting of the "out-of-bag club count" if several clubs 3 are removed and will not be replaced, and thereby prevents any club reminder alerts from occurring. The third function is a demo mode where the user can show how the invention operates and prevents a golfer from leaving his/her club behind.

In view of the above discussion, once installed on the bag 1, operation of the present invention 20 is as follows:

If a golf club 3 is removed from the bag 1 and not returned, the next time another club 3 is removed, the invention 20 "remembers" the originally-removed club 3 and initiates the alert. Thus, the LED display 36 indicates the number of clubs removed from the golf club bag 1 and not restored. The only time that the display indicates a "0" is when all of the clubs 3 have been restored. If two or more clubs 3 are taken out of the bag and then one is returned and the others are not replaced within 10 seconds of the first, the invention 20 emits a subtle beep tone (from the audio transducer 62), reminding the user to restore the remaining clubs.

It should be noted that the present invention 20 counts only the number of clubs 3 removed from the bag 1. When newly installed on a bag 1, the present invention 20 has no means to determine the number of clubs 3 currently in the bag 1. The number of clubs 3 contained in the bag 1 is not important; only the number of clubs 3 that have been removed matters. After a play, all clubs 3 removed must be returned to the bag 1. If this is not done, two things occur that will initiate a "club left behind" or reminder alarm: (1) If after a fixed amount of time the invention 20 detects sustained motion exceeding a fixed limit (e.g., 10 seconds), a reminder alarm (from the audio transducer 62) sounds. The golfer will instantly be reminded by the invention 20 that a club 3 has not been returned to the bag, at which point he/she can return to retrieve the club 3. This instant notification method eliminates the possibility of the golfer leaving his/her club behind, since he/she will not be able to travel more than several yards from the hole before they are notified. (2) If the golfer fails to hear the alarm while driving away in the golf cart and arrives at the next hole and removes yet another club(s), the reminder alarm will then again sound instantly and display the total number of clubs 3 now out of the bag. The golfer will then be alerted to the fact that one or more clubs 3 were removed at the last hole and not replaced back into the bag 1. He/she must then return to retrieve them. This shortened notification time increases the likelihood that the misplaced club will be recovered. Without the present invention 20, the golfer may not realize that a club 3 was left behind until quite some time or several holes later. The golfer can determine the current out-of-bag club-count at anytime by momentarily pressing the function switch 38. The club count is then displayed on the numeric LED display 36 and simultaneously checks the condition of the batteries. If the batteries are nearing depletion, a short audible reminder sounds every hour that the present invention 20 is in use. If one or more clubs 3 are removed from the bag during a game and loaned to another golfer to use, the owner may simply hold the function switch 38 down for a few seconds (e.g., 2 seconds), which resets the out-of-bag club count. This prevents the invention 20 from issuing a reminder alarm as the golfer drives off to the next hole. It further prevents any reminder alarm from occurring when the golfer arrives at the next hole and removes yet another club 3 from the bag 1.

Figure 13:
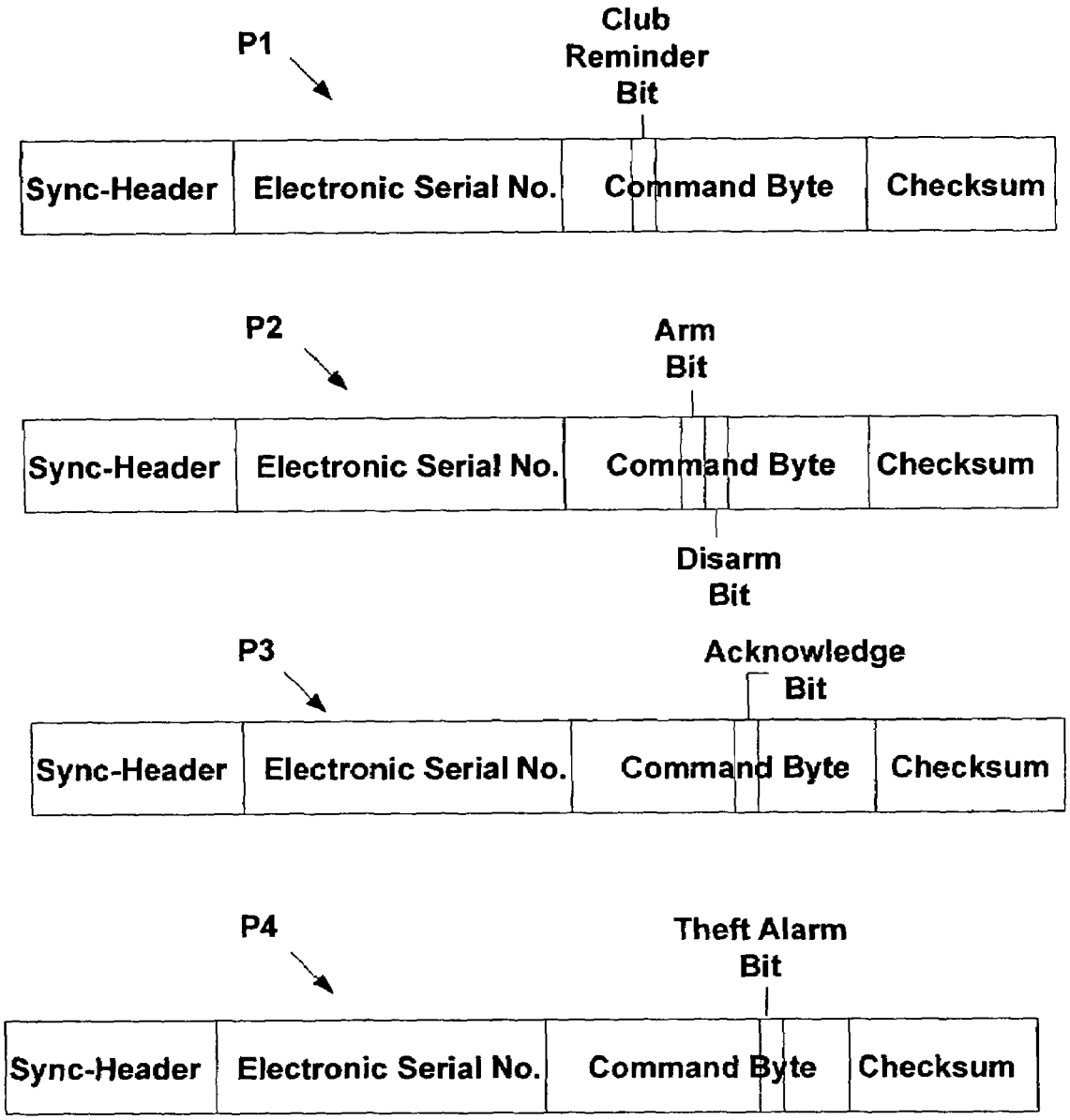
FIG. 13 depicts the format of the four types of digital packets used in communicating between the present invention, the pager and the monitor receiver, namely, the club reminder packet, the arm/disarm packet, the acknowledge packet and the alarm packet.

Further, if the pager 20A is operative (the details of which will be discussed later), the pager 20A also activates only a tactile indicator, e.g., a motorized vibrator 228 (see FIG. 11) in the event that the present invention 20 has sent a "club left behind" reminder signal (see club reminder digital packet P1 in FIG. 13) when the microcontroller 48 detects sustained motion for a period of time and the current club count is not zero i.e., that one or more clubs have been left behind en route to the next hole. The transceiver 70 (the details of which will also be discussed later) in the present invention 20 transmits a "club left behind" reminder signal to the pager 20A. Upon receipt of this signal from the transceiver 70, the pager 20A activates the vibrator 228. The pager 20A (which can be worn on the belt, placed in a pocket, or otherwise positioned or associated with the person such that a tactile indication is provided to the person when the vibrator 228 is activated) operates in this manner to alert the wearer who may be hearing-impaired or simply may not hear the activation of the audio transducer 62 contained in the present invention 20 but who will notice the vibrator annunciator 228 and thereby be alerted to return and retrieve the missing club(s). It operates in this manner also in order to reduce any annoyance to other golfers in the area who may feel disturbed at hearing such signals broadcast. Thus, other golfers will hear only the audio annunciator 62 of the present invention 20 and not a second simultaneous signal from the pager 20A.

It should also be noted that once the present invention 20 is installed on the golf club bag 1, the user does not need to activate it (power it on/off) because the invention 20 is activated as soon as a golf club 3 is removed or restored. When the batteries need replacement, the invention emits an predetermined (e.g., an hourly) audible alert using an unobtrusive tone only when in use to remind the user that the batteries are low. Once that low battery alert is active, the user will have at least eight hours of further use until operation stops.

As mentioned earlier, the present invention 20 can be supplemented with a remote alerting feature for the golfer himself/herself, as well as for alerting country club (or public golfing facility, etc.) personnel about a potential theft occurring, using the pager 20A and the monitor receiver 20B. To achieve this, as mentioned earlier, the present invention comprises the transceiver 70. This digital RF transceiver 70 operates to: (1) transmit a club reminder packet P1 to the pager 20A whenever the present invention 20 generates a club reminder signal that activates the missing club display 36 count and the audio transducer 62 and where the motion detector 56 detects a sustained motion of a predetermined period (e.g., 10–15 seconds); (2) receive an arm packet (or disarm packet) P2 (see FIG. 12) from the pager 20A and then to transmit an acknowledge packet P3 (FIG. 13) in response thereto. It should be understood that the transmission of the club reminder packet P1 occurs independently of the arm/disarm function.

Figure 10:
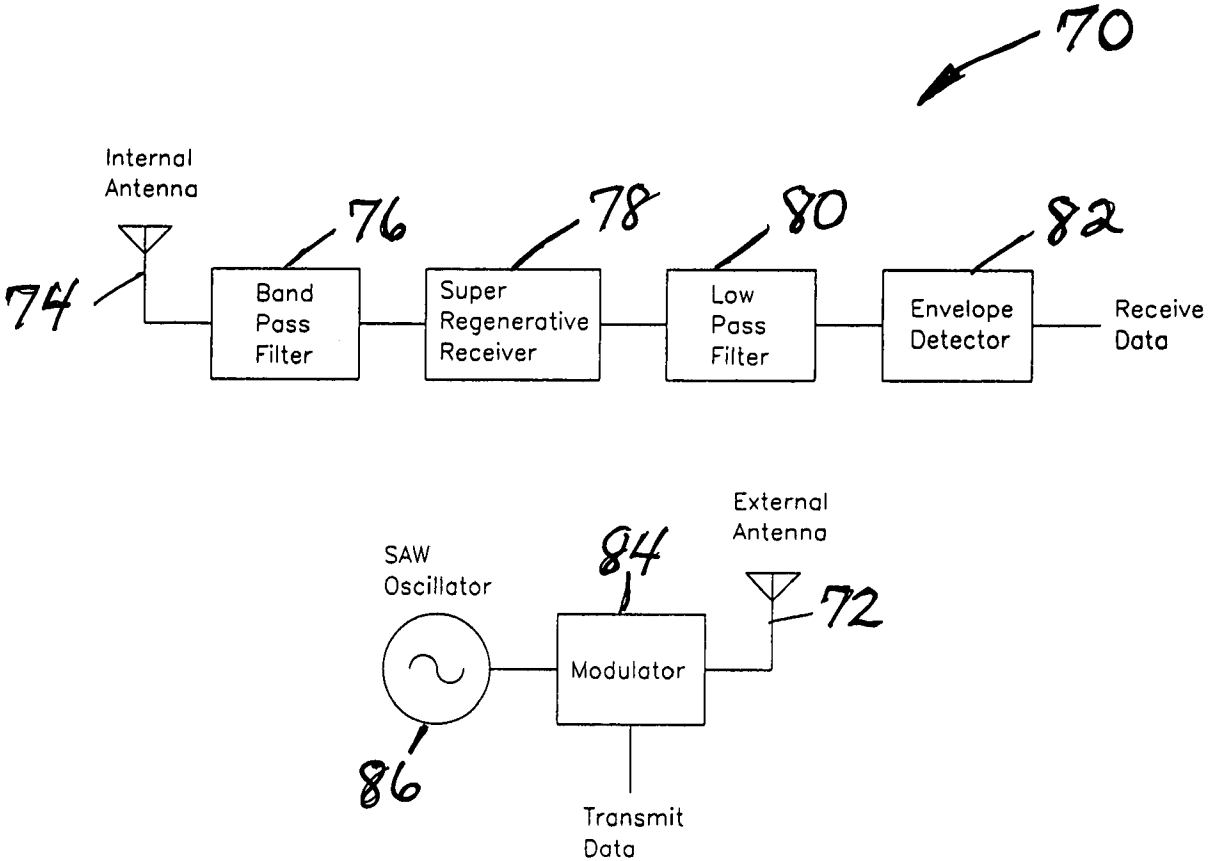
FIG. 10 is a block diagram of an exemplary transceiver used in the present invention.

In particular, the digital RF transceiver 70 comprises an external transmission antenna 72 and an internal receiver antenna 74 that are coupled to the transceiver electronics, as shown in FIG. 9. More particularly, as shown in FIG. 10, the internal antenna 74 may comprise a small quarter wave antenna etched into the printed circuit board of the electronics 46 and is used for the reception of signals from the transmitter of the pager 20A. The output of the internal antenna 74 is coupled to a band pass filter (BPF) 76 which provides out-of-band rejection of unwanted signals and increases the sensitivity of the receiver. The output of the BPF 76 feeds a super regenerative receiver 78; the super regenerative receiver 78 is a single stage transistor receiver with high gain, which demodulates symbol data commands from the transmitter of the pager 20A. The output of the super regenerative receiver 78 is coupled to a low pass filter 80 which provides RF attenuation of carrier frequency components and removes noise from base band data prior to reaching an envelope detector 82. The envelope detector 82 detects the presence or absence of an incoming signal using on/off keying (OOK) and is used to recover digital arm and disarm and acknowledge command data from the transmitter of the pager 20A. This data is then passed on to the microcontroller 48. The external transmission antenna 72 is coupled to a modulator 84. The modulator 84 performs transmitter carrier modulation in the form of on/off keying (OOK) for encoding non-return zero (NRZ) data for arm and disarm acknowledgment commands to the pager 20A, transmission of club reminder alerts and theft alarms to the pager 20A and monitor receiver 20B. In particular, the modulator 84 modulates the transmit data from the microcontroller 48 with a carrier signal generated by a SAW (surface acoustic wave) resonator 86. The carrier signal may comprise a signal in the ISM (industrial, scientific and medical) band, for example but not limited to, approximately 433 MHz (433.5 MHz–434.5 MHz). The modulated carrier signal is then transmitted via the external transmission antenna 72 to the pager 20A and monitor receiver 20B. The external transmission antenna 72 (e.g., a quarter wave wire antenna) may be positioned in a portion the belt assembly 24, as shown in FIG. 4A.

The present invention 20 can be armed or disarmed by the golf bag owner whenever he/she needs to be away from the bag 1 and wants to protect it and the contents from theft or other unauthorized contact. To accomplish this, the owner uses the pager 20A and depresses an arm/reset switch 232 which generates and transmits an arm packet P2 (FIG. 13) which contains the electronic serial indicia of the present invention 20A along with an arm bit. Upon receipt of the arm packet P2 from the pager 20A, the transceiver 70 demodulates this packet P2 and the microcontroller 48 processes the packet P2 data to first see if there is a match between its own electronic serial indicia and the electronic serial indicia in the packet P2. If there is a match, the microcontroller 48 notes the arm bit setting and thereby "arms" the present invention 20. The transceiver 70 then transmits an acknowledge packet P3 (FIG. 13) back to the pager 20A. If, on the other hand, there is no match between the electronic serial indicia stored in the microcontroller 48 and in the packet P2, the transceiver 70 sends no acknowledge packet P3 and does not alarm. Similarly, when the golf bag owner is ready to disarm the present invention 20, the owner simply depresses the disarm switch 234. This results in the generation and transmission of a disarm packet P2 (FIG. 13), which is similar to the arm packet except that a "disarm bit" is set instead of the arm bit. Again, assuming there is a match between the electronic serial indicia, the transceiver 70 transmits an acknowledge packet P3; otherwise, no acknowledge packet P3 is sent and the present invention 20 remains armed.

Figure 11:
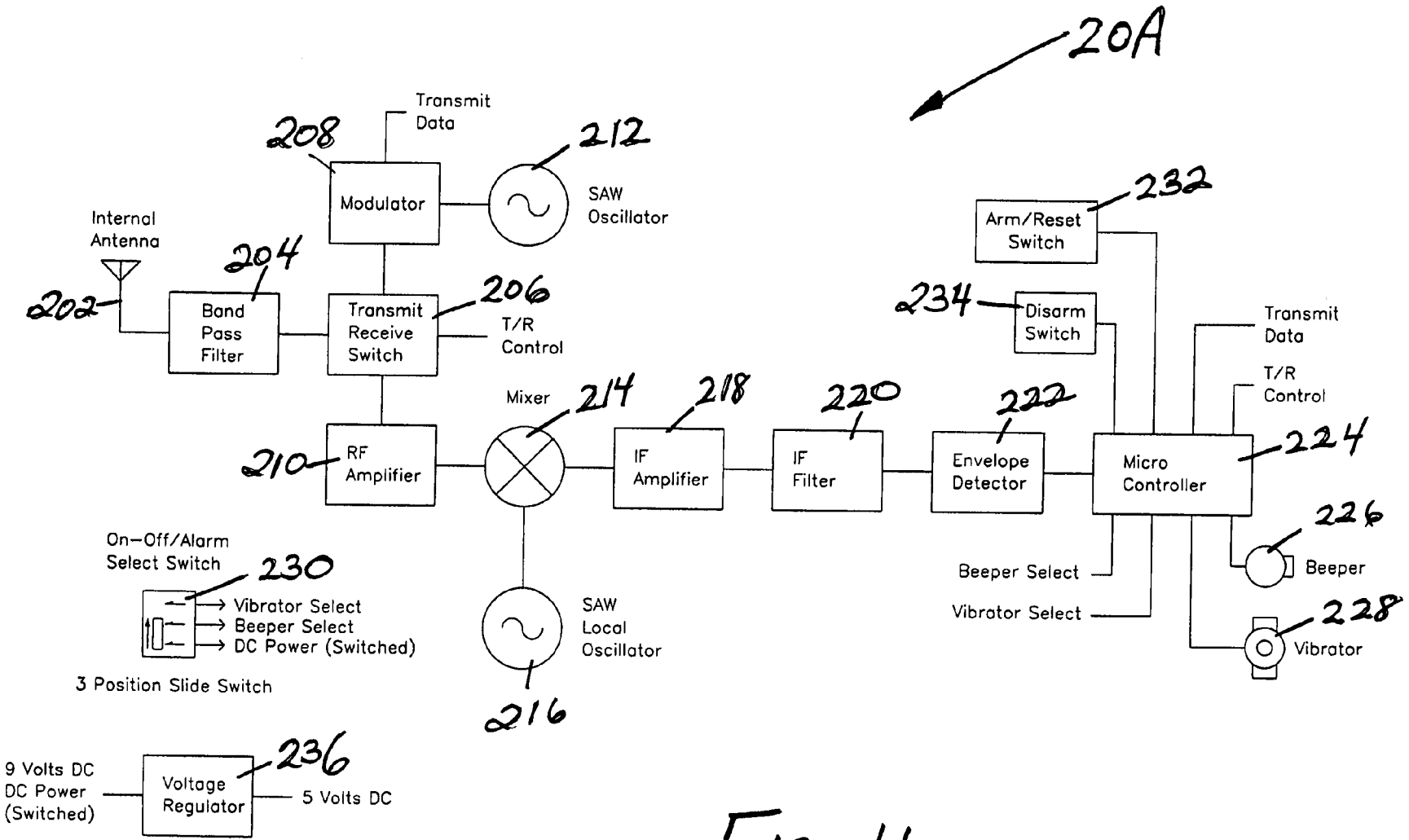
FIG. 11 is a block diagram of an exemplary pager that communicates with the transceiver of the present invention.

In particular, as shown in FIG. 11, the pager 20A comprises the following exemplary components: an internal antenna 202 which may comprise a small quarter wave antenna that is etched into a printed circuit board (not shown) of the pager 20A and is used for both the transmission and reception of data. The antenna 202 is coupled to a band pass filter (BPF) 204 which provides out-of-band rejection of unwanted signals and increases the sensitivity of the receiver. The BPF 204 also reduces the second and third harmonic energy of the transmitter carrier frequency generator. The BPF 204 is coupled to a transmit/receive switch 206 which connects the antenna 202 to the transmitter's modulator carrier generator 208 or to an RF amplifier 210; the switch 210 allows both the transmitter and the receiver to share the antenna 202. The modulator 208 performs transmitter carrier modulation in the form of on/off keying (OOK) for encoding non-return zero (NRZ) data for arm and disarm and acknowledge commands to the receiver in the present invention 20. An oscillator 212 comprises a SAW resonator for generating the transmitter's carrier frequency signal. The RF amplifier 210 provides signal voltage gain after the BPF 204 for increasing the receiver's sensitivity. A mixer 214 takes the output from the RF amplifier 210 and heterodynes that signal with a local oscillator 216 (which comprises a SAW resonator) signal to form a lower intermediate frequency (IF) signal for further filtering, amplification and demodulation. The output of the mixer 214 is fed to an IF amplifier 218 that provides IF signal gain, followed by an IF filter 220 for reducing adjacent channel interference and noise power reduction from previous stages of the receiver chain. The output of the IF filter 220 is fed to an envelope detector 222 which detects the presence or absence of an incoming carrier frequency signal using OOK and is used to recover digital data from the transceiver 70 in the present invention 20. The output of the envelope detector 222 is fed to a microcontroller 224 that generates digital message packets for arming and disarming the present invention 20. In addition, the microcontroller 224 provides base band symbol demodulation of the incoming club reminder and theft alarm data streams from the present invention 20. The microcontroller 224 energizes a magnetic audio transducer 226 to generate an audible warning tone whenever an armed present invention 20 issues a theft alarm; similarly, the microcontroller 224 energizes a motorized vibrator 228 to generate a tactile warning that a club is left behind or when an armed present invention 20 issues a theft alarm. The pager 20A also includes a power alarm select switch 230 (e.g., a 3-position switch) that functions as an on/off switch and allows the user to select the audio transducer 226 or the vibrator 228 as the warning device. The pager 20A permits the golfer to "arm" or "disarm" the present invention 20 in order to provide the remote alert mentioned earlier. Therefore, the pager 20A includes an arm/reset switch 232 and a disarm switch 234. The arm/reset switch 232 comprises a momentary contact switch that, when pressed, activates the pager 20A transmitter to send an arm command packet to the transceiver 70 of the present invention. This arm/reset switch 232 is also used to reset and turn off the audio transducer 226 (e.g., beeper) or vibrator 228 when a alarm command is received. The disarm switch 234 comprises a momentary contact switch used to disarm the present invention 20. Pressing the disarm switch 234 activates the pager 20A transmitter to send a disarm command packet to the transceiver 70 of the present invention 20. The pager 20A also includes a voltage regulator 236 that reduces the battery voltage to a lower value and maintains a constant supply voltage to the pager 20A circuitry.

Once the present invention 20 is armed, the top/bottom coil 26/126 paths and the motion sensor 56 path are used by the microcontroller 48 to determine whether to issue an alarm signal or not. Should an unauthorized person attempt to reach into the bag 1 and remove a club 3, or in anyway move the bag 1 itself, such action will be detected by the present invention 20 and the microcontroller 48 activates the transceiver 70 to issue an alarm packet P4 (see FIG. 13). The alarm packet comprises the electronic serial indicia of the present invention 20 that is armed and whose bag 1 or contents has been tampered with; the alarm packet also includes a theft alarm bit. Upon receipt of the alarm packet by the receiver of a pager 20A, the pager 20A demodulates the alarm packet and determines if there is a match between the electronic serial indicia stored in the microcontroller 224 and in the alarm packet P4. If there is a match and the alarm bit is set, the microcontroller 224 activates either the beeper 226 or the vibrator 228 as set by the power alarm select switch 230; if there is no match, the pager 20A remains silent.

Simultaneously, the alarm packet P4 is received by the monitor receiver 20B, assuming the armed present invention 20 is within range of the monitor receiver 20B. As mentioned earlier, the monitor receiver 20B is installed at a fixed site location where golf carts are parked of golf bags are left unattended by their owners (e.g., the country club house, public golfing facility house, etc.). Since the monitor receiver 20B does not need to distinguish an alarm packet based upon a particular electronic serial indicia, the monitor receiver 20B checks to see if the alarm bit is set. If the alarm bit is set and depending upon how the monitor receiver 20B is configured to interface with the existing security equipment 1000, the monitor receiver 20B may sound an alarm alerting country club (or public golfing facility, etc.) personnel, as well as the golf bag owner, of a theft or other unauthorized contact occurring; alternatively, or in addition, a video camera may be activated to record the unauthorized act(s).

Figure 12:
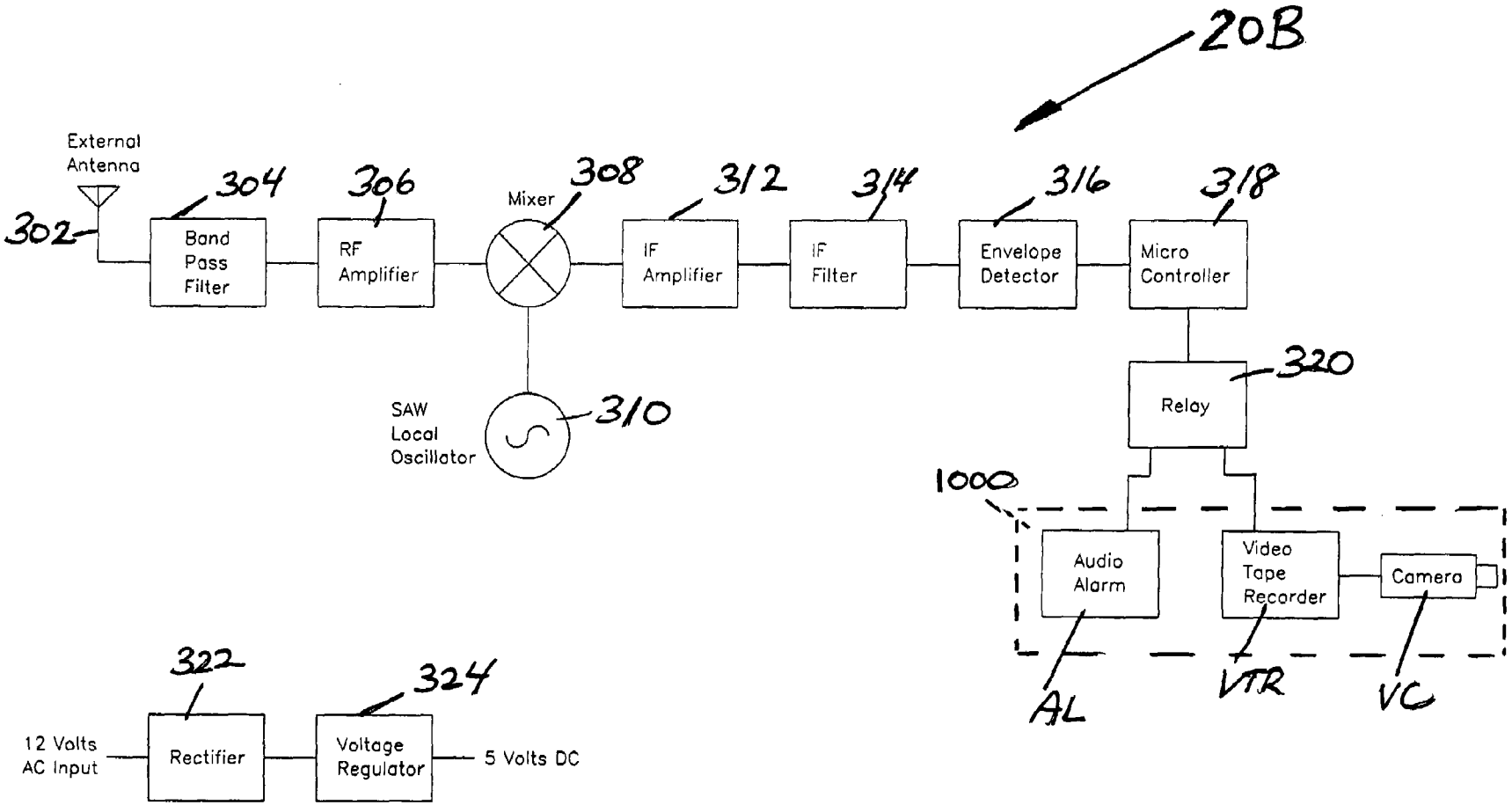
FIG. 12 is a block diagram of an exemplary monitor receiver that communicates with the transceiver of the present invention and energizes an alarm and/or a video camera at a country club (or public golfing facility, etc.) when unauthorized contact of a golf club bag, using the present invention, is occurring.

In particular, the monitor receiver 20B is a line powered wide area RF monitoring receiver that is installed at a fixed site adjacent to or in a common area where golf carts are parked or wherever golf bags are left unattended. It receives all RF transmissions from any armed golf bag component activated by an attempted theft within the receiver's coverage area. Upon the detection and receipt of any theft alarm signal, it then actuates a relay contact closure that will alert an employee or attendant nearby by an audible or visual means. The relay closure may further activate a video recording device to obtain visual evidence for criminal prosecution of an actual theft occurring in the area under surveillance. As shown in FIG. 12, the monitor receiver 20B comprises the following exemplary components: an external antenna 302 which may comprise a quarter wave monopole antenna that receives transmissions from the transceiver 70. The antenna 302 is coupled to a BPF 304 which provides out-of-band rejection of unwanted signals and increases the sensitivity of the receiver. The BPF 304 is coupled to an RF amplifier 306 which provides signal voltage gain after the BPF 304 for increasing the receiver's sensitivity. A mixer 308 takes the output from the RF amplifier 306 and heterodynes that signal with a local oscillator 310 (which comprises a SAW resonator) signal to form a lower intermediate frequency (IF) signal for further filtering, amplification and demodulation. The output of the mixer 308 is fed to an IF amplifier 312 that provides IF signal gain, followed by an IF filter 314 for reducing adjacent channel interference and noise power reduction from previous stages of the receiver chain. The output of the IF filter 314 is fed to an envelope detector 316 which detects the presence or absence of an incoming signal and is used to recover digital data from the transceiver 70 in the present invention 20. The output of the envelope detector 316 is fed to a microcontroller 318 that provides symbol demodulation of the incoming alarm data packets from transmitters in the plurality of present inventions 20 that have been armed. Depending on whether there is an alarm signal to be generated or not, the microcontroller 318 energizes a relay 320 that activates either (or both) an audio alarm AL or a video tape recorder VTR and video camera VC. The activation of these security devices alerts country club (or public golfing facility, etc.) personnel of a theft occurrence and records the occurrence. These last three security devices 1000 are not part of the monitor receiver 20B itself but are provided by, or already exist at, the country club (or public golfing, etc.) facility. The monitor receiver 20B operates of off line power and therefore includes a rectifier 322 for converting line power through a wall-mounted step-down transformer to 12VAC to a DC voltage which is then maintained by a voltage regulator 324 to provide a constant supply voltage (e.g., 5VDC) to the monitor receiver 20B circuitry.

The configuration of the present invention 20, along with the pager 20A and monitor receiver 20B, provides a unique alerting system that prevents the theft of a golf bag and/or its contents. Once armed, the present invention 20 can detect either (or both) the movement of the golf bag 1 or the removal of just a single golf club 3 from the bag 1 and then emit the alarm packet P4. As a result, if a would-be thief were to notice the presence of the present invention 20 and incorrectly conclude that the present invention 20 only detected the movement of the bag 1, he/she would be surprised to find out later that by removing one or more golf clubs 3 from the bag 1, the present invention 20 had emitted an alarm packet P4 to both the pager 20A and the monitor receiver 20B. Thus, the present invention 20, along with the pager 20A and monitor receiver 20B, provide comprehensive protection of a golf bag and/or its contents.

Figure 14A:
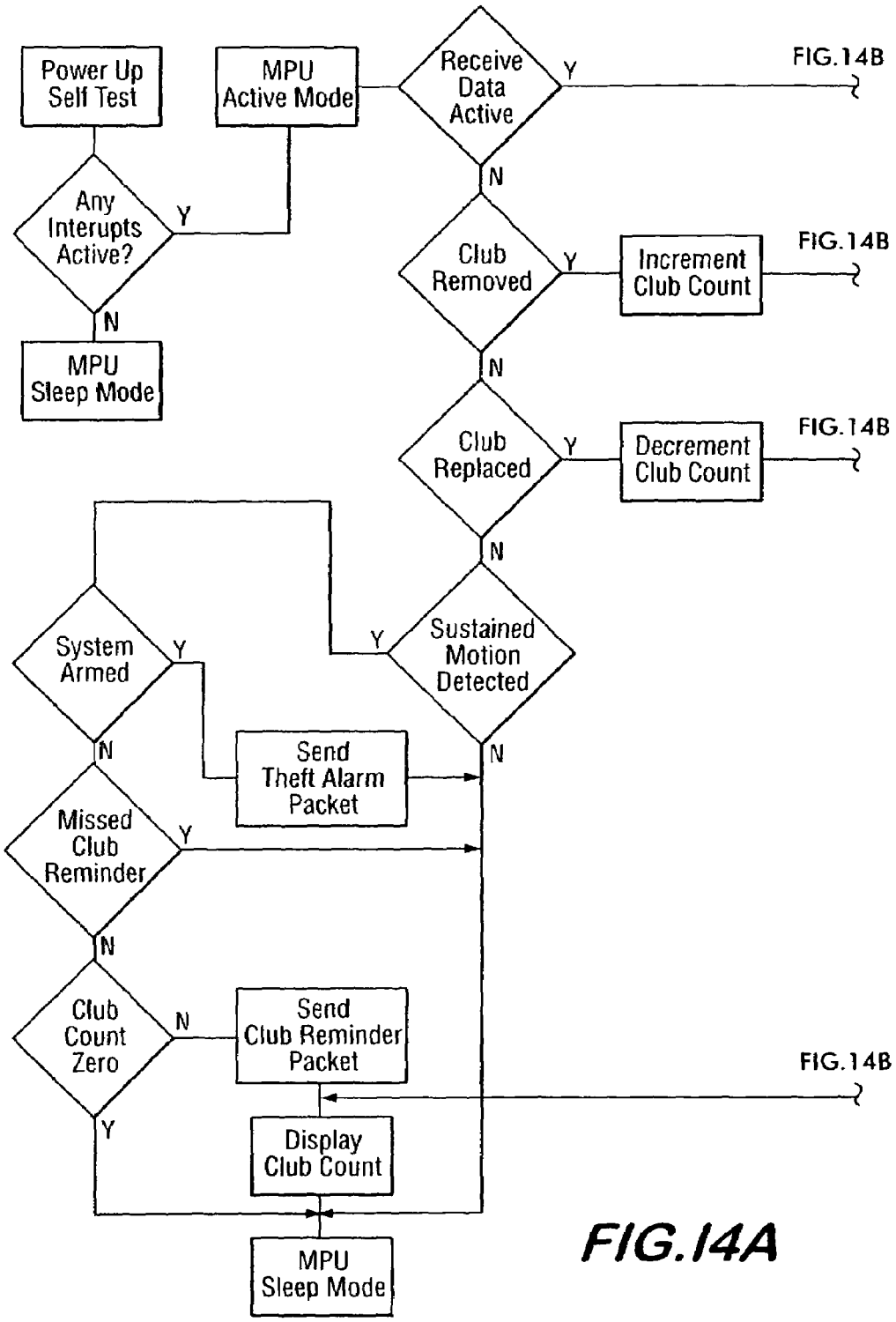
FIGS. 14A–14C together form a flow diagram of the operation of the microcontroller of the present invention.
Figure 14B:
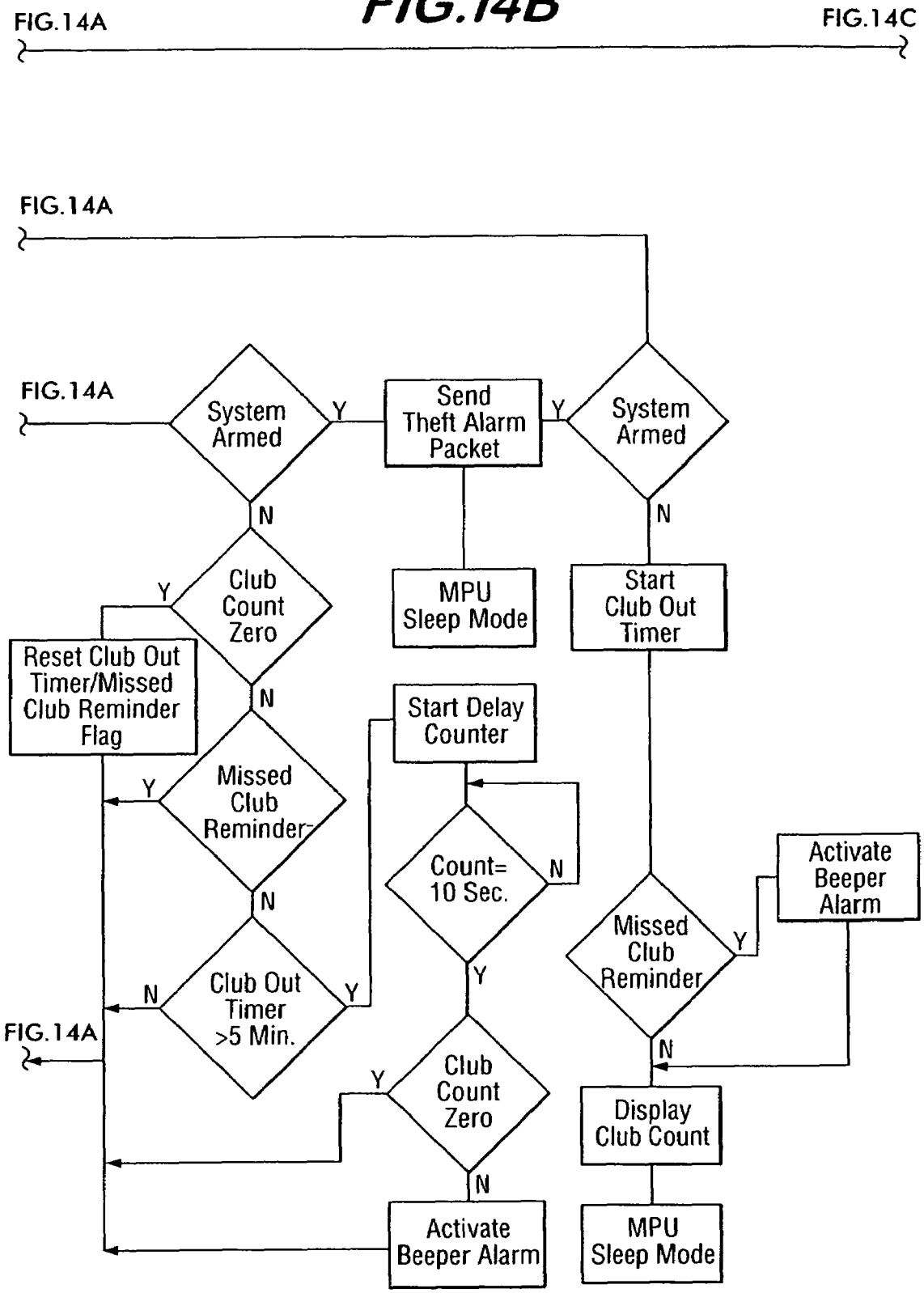
Figures 14B, 14C:
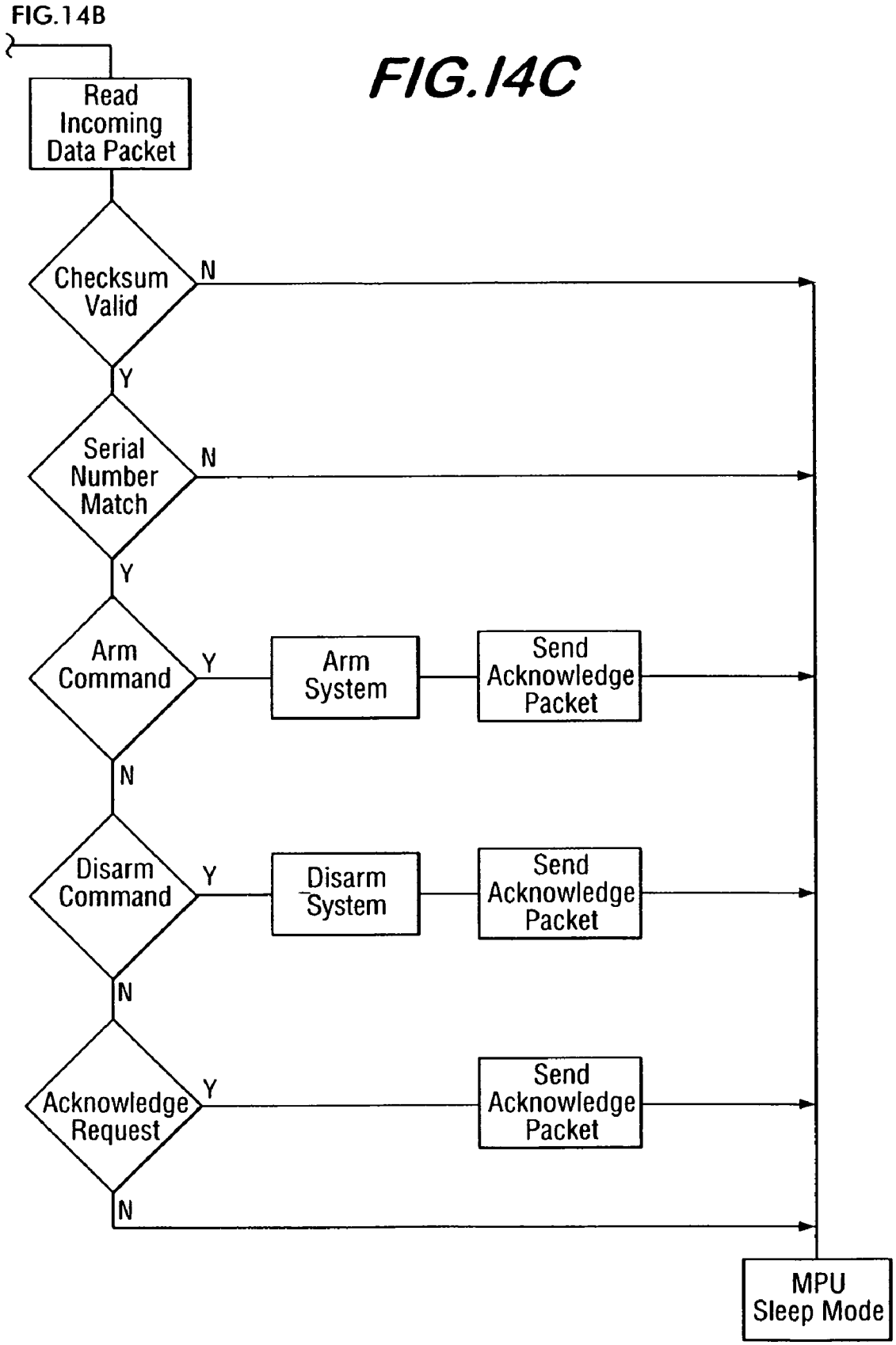

A flow diagram of the microcontroller 48 operation of the present invention 20 is given in FIGS. 14A–14C; the microcontroller 48 is referred to as the "MPU" in that flow diagram.

Thus, in view of all of the above, the present invention 20 provides for reminding golfers when clubs have been forgotten or misplaced on the green and thus eliminates the problem of lost clubs, saving golfers time and money. The present invention 20 instantly reminds a golfer, as he/she moves on to the next hole, that they have left a club out of the bag. This reduces the retrieval time for misplaced clubs and further increases the chances of recovering the forgotten club. Furthermore, to eliminate the theft of an expensive club or the entire bag, the present invention 20 sends a wireless alarm signal to a golfer carried pager and also a facility monitor receiver whenever someone lifts, moves, or takes a club or clubs out of the bag. This instant notification of a theft in progress will allow the golfer and personnel of the golfing facility to take immediate action in apprehending the thief.

The present invention 20 utilizes none of the known methods, discussed earlier, to sense the removal or replacement of a club. Further, unlike any existing system, the present invention 20 uses motion sensing to initiate an alarm if a club 3 is missing from the bag 1 as the golfer leaves the area.

It should be understood that it is within the broadest scope of the present invention to include the enclosure 22 and the sensor belt assembly 24 as being formed integrally (not shown) with the golf bag 1 itself. Thus, instead of being a device that couples to the golf bag 1, during manufacture of the golf bag 1 itself, the enclosure and the sensor belt assembly are embedded in the golf bag 1. Similarly, it is within the broadest scope of the present invention to include the sensor tags 32 on each of the golf clubs 3 that are purchased with the golf bag 1 that includes the integrated enclosure 22/sensor belt assembly 24.

While the invention has been described in detail and with reference to specific examples thereof, it will be apparent to one skilled in the art that various changes and modifications can be made therein without departing from the spirit and scope thereof.

What is claimed is:

1. An apparatus for automatically counting golf clubs removed from a conventional golf club bag and automatically alerting the user that the number of removed golf clubs have not been returned to the conventional golf club bag, said apparatus comprising:

a detector disposed around the opening of the conventional golf club bag for generating a signal when the item is moved through the opening of the bag;

a tag coupled to each of the golf clubs that is detected by said detector when any of the golf clubs is moved through the opening of the bag;

a controller, coupled to said detector, that is activated by receipt of said signal, said controller processing said signal and controlling a display indicating the number of golf clubs removed from the bag; and a motion sensor coupled to said controller for detecting sustained motion of the bag.

2. The apparatus of claim 1 wherein sustained motion of the bag comprises motion occurring for approximately 10–15 seconds.

3. The apparatus of claim 2 further comprising an indicator controlled by said controller, said controller activating said indicator whenever said sustained motion occurs and said detector has detected that at least one golf club has not been returned to the bag.

4. The apparatus of claim 3 wherein said indicator comprises an audible indicator.

5. The apparatus of claim 3 further comprising a transmitter that is controlled by said controller, said controller activating said transmitter to emit a wireless signal whenever said sustained motion occurs and said detector has detected that at least one golf club has not been returned to the bag.

6. The apparatus of claim 5 further comprising a receiver associated with an authorized user of the conventional golf bag, said receiver being coupled to an indicator and wherein said indicator is activated whenever said receiver receives said wireless signal.

7. The apparatus of claim 5 wherein said indicator is a tactile indicator.

8. The apparatus of claim 2 further comprising:

a first transmitter that is controlled by said controller, said controller activating said transmitter to emit a wireless signal whenever said sustained motion occurs or whenever at least one golf club is removed from said conventional golf bag; and a first receiver associated with an authorized user of the conventional golf bag, said first receiver being coupled to an indicator and wherein said indicator is activated whenever said first receiver receives said wireless signal.

9. The apparatus of claim 8 further comprising a second receiver and a second transmitter, said second receiver being coupled to said first transmitter and said second transmitter being associated with the authorized user, said second transmitter permitting the authorized user to send an arm signal or a disarm signal to said second receiver in order to enable or disable said first transmitter.

10. The apparatus of claim 8 further comprising a second receiver secured to a structure on golf course grounds having a video camera or audio alarm equipment, said second receiver being coupled to said video camera or audio alarm equipment and activating said video camera or audio alarm equipment whenever said second receiver receives said wireless signal.

11. The apparatus of claim 9 further comprising a third receiver secured to a structure on golf course grounds having a video camera or audio alarm equipment, said third receiver being coupled to said video camera or audio alarm equipment and activating said video camera or audio alarm equipment whenever said third receiver receives said wireless signal.

12. An apparatus for automatically counting golf clubs removed from a conventional golf club bag and automatically alerting the user that the number of removed golf clubs have not been returned to the conventional golf club bag, said apparatus comprising:

a detector disposed around the opening of the conventional golf club bag for generating a signal when the item is moved through the opening of the bag, said detector comprising a first coil disposed around the opening of the conventional golf club bag and a second coil disposed around the opening of the bag, said first and second coils being separated from each other by a predetermined distance;

a tag coupled to each of the golf clubs that is detected by said detector when any of the golf clubs is moved through the opening of the bag, said tag comprising a magnet that induces a voltage signal in said first and second coils when moved through the opening of the bag;

a controller, coupled to said detector, that is activated by receipt of said signal, said controller processing said signal and controlling a display indicating the number of golf clubs removed from the bag;

wherein said detector detects the induced voltage signal regardless of the north/south pole orientation of said magnet on the removed golf club; and wherein said voltage induced in each of said coils comprises a bipolar pulse signal having a first portion above a DC reference voltage and a second portion below said DC reference, and wherein each of said coils comprises a respective comparator stage that compares the amplitude of said first and second portions against respective DC threshold voltages.

13. The apparatus of claim 12 wherein each comparator stage comprises a first comparator for comparing said first portion against a first threshold voltage above said DC reference voltage and a second comparator for comparing said second portion against a second threshold voltage below said DC reference voltage.

14. An apparatus for automatically counting golf clubs removed from a conventional golf club bag and automatically alerting the user that the number of removed golf clubs have not been returned to the conventional golf club bag, said apparatus comprising:

a detector disposed around the opening of the conventional golf club bag for generating a signal when the item is moved through the opening of the bag, said detector comprising a first coil disposed around the opening of the conventional golf club bag and a second coil disposed around the opening of the bag, said first and second coils being separated from each other by a predetermined distance;

a tag coupled to each of the golf clubs that is detected by said detector when any of the golf clubs is moved through the opening of the bag, said tag comprising a magnet that induces a voltage signal in said first and second coils when moved through the opening of the bag;

a controller, coupled to said detector, that is activated by receipt of said signal, said controller processing said signal and controlling a display indicating the number of golf clubs removed from the bag;

wherein said detector detects the induced voltage signal regardless of the north/south pole orientation of said magnet on the removed golf club; and wherein each of said coils comprises a respective signal detection path, each signal detection path comprising a low pass filter for filtering out high frequency signals.

15. An apparatus for providing an indication as to the unauthorized contact or movement of a golf club bag, said apparatus comprising:

a motion detector coupled to the bag for emitting motion detector signals whenever the bag is experiencing motion;

a first transmitter, coupled to said motion detector, for emitting a wireless signal whenever said motion detector emits said motion detector signals;

a first receiver associated with a person who has authorized control of the bag, said receiver having an indicator and wherein said indicator is activated whenever said first receiver receives said wireless signal.

16. The apparatus of claim 15 further comprising a second receiver and a second transmitter, said second receiver being coupled to said first transmitter and said second transmitter being associated with the person, said second transmitter permitting the person to send an arm signal or a disarm signal to said second receiver in order to enable or disable said first transmitter.

17. The apparatus of claim 16 wherein the golf club bag is positioned on golf course grounds that include a structure having a video camera or audio alarm equipment and wherein the apparatus further comprises a third receiver secured to the structure, said third receiver being coupled to said video camera or audio alarm equipment and activating said video camera or audio alarm equipment whenever said third receiver receives said wireless signal.

18. The apparatus of claim 15 wherein said indicator comprises a tactile indicator.

19. The apparatus of claim 15 wherein said indicator comprises an audible indicator.

20. A system for providing an indication as to the unauthorized contact or movement of at least one golf bag from a plurality of golf club bags positioned on golf course grounds that include a structure having a video camera or audio alarm equipment, said system comprising:

a respective motion detector coupled to each one of the plurality of bags for emitting respective motion detector signals whenever each one of the plurality of bags is experiencing motion;

a respective transmitter, coupled to each one of said respective motion detectors, for emitting respective wireless signals whenever said respective motion detector emits said respective motion detector signals;

a receiver secured to the structure, said receiver being coupled to said video camera or audio alarm equipment and activating said video camera or audio alarm equipment whenever said receiver receives at least one wireless signal.

21. The system of claim 20 further comprising a respective receiver, associated with a person who has authorized control of one of said plurality of golf bags, said respective receiver having an indicator and wherein said indicator is activated whenever said respective receiver receives said respective wireless signals.

22. The apparatus of claim 21 wherein said indicator comprises a tactile indicator.

23. The apparatus of claim 21 wherein said indicator comprises an audible indicator.

24. The apparatus of claim 21 further comprising a respective receiver coupled to said respective transmitter and further including a respective transmitter associated with the person who has authorized control of one of said plurality of golf bags, said respective transmitter associated with the person permitting the person to send an arm signal or a disarm signal to said respective receiver in order to enable or disable said respective transmitter.

25. A method for automatically detecting the removal of a golf club from a conventional golf club bag and automatically providing a count of the golf clubs that have not been restored to the bag, said method comprising the steps of:

coupling a tag to each golf club in the conventional golf club bag;

disposing a detector around the opening of the bag which generates a signal each time a golf club, including a tag, is moved through the opening;

coupling a motion sensor to the bag and producing a motion sensor signal and electrically coupling said motion sensor to a controller for detecting sustained motion of the bag;

activating said controller by said signal which then processes said signal and said motion sensor signal; and controlling a display, by said controller, to indicate the number of golf clubs removed from the bag.

26. The method of claim 25 wherein sustained motion of the bag comprises motion occurring for approximately 10–15 seconds.

27. The method of claim 25 further comprising the step of disposing an indicator to the bag that is controlled by said controller, said controller activating said indicator whenever said sustained motion occurs and said detector has detected that at least one golf club has not been returned to the bag.

28. The method of claim 27 wherein said indicator comprises an audible indicator.

29. The method of claim 27 further comprising the step of permitting the user to prevent said indicator from activating.

30. The method of claim 29 further comprising the step of activating a remotely-located indicator associated with the user of the conventional golf bag whenever a remotely-located receiver, coupled to said remotely-located indicator, receives said wireless signal.

31. The method of claim 30 wherein said remotely-located indicator comprises a tactile indicator worn by the user.

32. The method of claim 25 further comprising the steps of:

emitting a wireless signal whenever said sustained motion occurs or whenever at least one golf club is removed from said conventional golf bag; and alerting an authorized user of the conventional golf bag that said conventional golf bag has been moved or that at least one golf club has been removed whenever a receiver, associated with the authorized user, receives said wireless signal.

33. The method of claim 32 further comprising the step of permitting the authorized user to enable or disable said emission of a wireless signal.

34. The method of claim 33 wherein said step of permitting the authorized user to enable or disable said emission of a wireless signal comprises permitting the authorized user to remotely enable or disable said emission of a wireless signal.

35. The method of claim 33 wherein the conventional golf bag is present on golf course grounds having a structure including a video camera or audio alarm equipment, said method further comprising the steps of:

providing a second receiver at said structure which is coupled to said video camera or said audio alarm equipment; and activating said video camera or audio alarm equipment whenever said second receiver receives said wireless signal.

36. The method of claim 32 wherein the conventional golf bag is present on golf course grounds having a structure including a video camera or audio alarm equipment, said method further comprising the steps of:

providing a second receiver at said structure which is coupled to said video camera or said audio alarm equipment; and activating said video camera or audio alarm equipment whenever said second receiver receives said wireless signal.

37. A method for automatically detecting the removal of a golf club from a conventional golf club bag and automatically providing a count of the golf clubs that have not been restored to the bag, said method comprising the steps of:

coupling a tag to each golf club in the conventional golf club bag;

disposing a detector around the opening of the bag which generates a signal each time a golf club, including a tag, is moved through the opening;

activating a controller by said signal which then processes said signal; and controlling a display, by said controller, to indicate the number of golf clubs removed from the bag; and permitting the user to reset said display.

38. A method for automatically detecting the removal of a golf club from a conventional golf club bag and automatically providing a count of the golf clubs that have not been restored to the bag, said method comprising the steps of:

coupling a tag to each golf club in the conventional golf club bag;

disposing a detector around the opening of the bag which generates a signal each time a golf club, including a tag, is moved through the opening;

activating a controller by said signal which then processes said signal; controlling a display, by said controller, to indicate the number of golf clubs removed from the bag; and emitting a wireless signal whenever said sustained motion occurs and said detector has detected that at least one golf club has not been returned to the bag.

39. A method for providing an indication as to the unauthorized contact or movement of a golf club bag, said method comprising the steps of:

coupling a motion detector coupled to the bag for emitting motion detector signals whenever the bag is experiencing motion;

emitting a wireless signal whenever said motion detector emits said motion detector signals;

activating a remotely-located indicator associated with a person who has authorized control of the bag whenever said wireless signal is received by a remotely-located receiver coupled to said remotely-located indicator.

40. The method of claim 39 wherein said indicator comprises a tactile indicator.

41. The method of claim 39 wherein said indicator comprises an audible indicator.

42. The method of claim 39 further comprising the step of permitting the person who has authorized control of the bag to enable or disable said step of emitting a wireless signal.

43. The method of claim 39 wherein the golf club bag is positioned on golf course grounds that include a structure having a video camera or audio alarm equipment and further comprising the step of activating said video camera or audio alarm equipment whenever a receiver coupled to said video camera or audio alarm receives said wireless signal.

44. A method for providing an indication as to the unauthorized contact or movement of at least one golf bag from a plurality of golf club bags positioned on golf course grounds that include a structure having a video camera or audio alarm equipment, said method comprising the steps of:

coupling a respective motion detector to each one of the plurality of bags for emitting respective motion detector signals whenever each one of the plurality of bags is experiencing motion;

emitting respective wireless signals whenever said respective motion detector emits said respective motion detector signals;

activating said video camera or audio alarm equipment whenever a receiver, coupled to said video camera or audio alarm, receives at least one wireless signal.

45. The method of claim 44 further comprising the step of activating a remotely-located indicator associated with a person who has authorized control of one of said plurality of golf bags whenever a respective remotely-located receiver, coupled to said indicator, receives said respective wireless signals.

46. The method of claim 45 wherein said indicator comprises a tactile indicator.

47. The method of claim 45 wherein said indicator comprises an audible indicator.

48. The method of claim 45 further comprising the step of permitting the person to send an arm signal or a disarm signal to said respective receiver in order to enable or disable said enable or disable said step of emitting respective wireless signal.

* * * * *